US011141974B2

(12) United States Patent
Oohashi et al.

(10) Patent No.: US 11,141,974 B2
(45) Date of Patent: Oct. 12, 2021

(54) PRINT ELEMENT SUBSTRATE, LIQUID DISCHARGE HEAD, AND LIQUID DISCHARGE APPARATUS

(71) Applicant: CANON KABUSHIKI KAISHA, Tokyo (JP)

(72) Inventors: Ryoji Oohashi, Yokohama (JP); Yoshinori Misumi, Tokyo (JP); Yuzuru Ishida, Yokohama (JP); Tsubasa Funabashi, Yokohama (JP); Maki Kato, Fuchu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 6 days.

(21) Appl. No.: 16/432,225

(22) Filed: Jun. 5, 2019

(65) Prior Publication Data

US 2019/0389213 A1 Dec. 26, 2019

(30) Foreign Application Priority Data

Jun. 25, 2018 (JP) ..... JP2018-119919

(51) Int. Cl.
*B41J 2/14* (2006.01)

(52) U.S. Cl.
CPC ..... *B41J 2/14072* (2013.01); *B41J 2/14153* (2013.01); *B41J 2002/14491* (2013.01)

(58) Field of Classification Search
CPC ..... B41J 2/14072; B41J 2/18; B41J 2/1404; B41J 2/17526; B41J 2/04523; B41J 2/04521; B41J 2/145; B41J 2/15; B41J 2/155; B41J 2002/14491; B41J 2202/12; B41J 2202/20; B41J 2202/21
See application file for complete search history.

(56) References Cited

U.S. PATENT DOCUMENTS

| | | | | |
|---|---|---|---|---|
| 6,409,319 | B1 | 6/2002 | Taneya et al. | 347/65 |
| 6,474,792 | B2 | 11/2002 | Sugiyama et al. | 347/65 |
| 6,530,650 | B2 | 3/2003 | Ozaki et al. | 347/64 |
| 6,827,416 | B2 | 12/2004 | Matsumoto et al. | 347/17 |
| 8,066,347 | B2 | 11/2011 | Tamura et al. | 347/17 |
| 8,070,263 | B2 | 12/2011 | Oohashi et al. | 347/58 |
| 8,109,593 | B2 | 2/2012 | Oohashi et al. | 347/17 |
| 9,061,489 | B2 | 6/2015 | Sakurai et al. | B41J 2/0451 |
| 9,085,143 | B2 | 7/2015 | Ishida et al. | B41J 2/14088 |
| 9,096,059 | B2 | 8/2015 | Hatsui et al. | B41J 2/14112 |
| 2002/0060721 | A1* | 5/2002 | Takada et al. | B41J 2/14048 |
| 2017/0197420 | A1* | 7/2017 | Okushima et al. | B41J 2/1404 |
| 2018/0104954 | A1 | 4/2018 | Osuki et al. | B41J 2/14088 |
| 2019/0308416 | A1 | 10/2019 | Nagamochi et al. | B41J 2/1629 |

FOREIGN PATENT DOCUMENTS

JP 2006-168050 A 6/2006

* cited by examiner

*Primary Examiner* — Lamson D Nguyen
(74) *Attorney, Agent, or Firm* — Venable LLP

(57) ABSTRACT

In a layer including print elements and a layer below the layer including the print elements in a lamination direction of a print element substrate, the print elements and drive circuits are arranged point-symmetrically about the center of the substrate viewed from a side where discharge ports that allow the liquid to be discharged are open, and in an upper layer over the layer including the print elements in the lamination direction, functional elements are arranged in a direction of liquid flow in which the liquid flows from supply ports to collection ports while passing above the print elements.

12 Claims, 19 Drawing Sheets

PRINT ELEMENT SUBSTRATE, LIQUID DISCHARGE HEAD, AND LIQUID DISCHARGE APPARATUS

BACKGROUND OF THE INVENTION

Field of the Invention

The present invention relates to a print element substrate, a liquid discharge head, and a liquid discharge apparatus.

Description of the Related Art

Recently, print element substrates have been required to be highly condensed for being used in a liquid discharge head of a liquid discharge apparatus in a printer and the like. The print element substrates each include print elements and drive circuits for the print elements formed on the same semiconductor substrate. In addition, the print element substrates have also been required to be downsized to increase the number of the print element substrates that can be produced from one wafer.

Japanese Patent Laid-Open No. 2006-168050 discloses a technique that achieves reduction of the layout design load while inhibiting the size increase of the print element substrate by arranging aligned rows of print elements and drive circuits for driving the print elements on the substrate point-symmetrically about the center of the substrate.

Some of the print element substrates are used for the liquid discharge head of the liquid discharge apparatus in which a liquid is circulated. That is, in some of the print element substrates, the liquid flows into the print element substrate from outside, and a part of the liquid that is not discharged from the print element substrate flows out along a circulation direction. The flowed out liquid flows into a tank and then flows into the print element substrate again. In general, the circulation direction of the liquid in the print element substrate is fixed so that the liquid is discharged in the fixed direction.

A functional element that affects the liquid flowing through the print element substrate may be arranged in the print element substrate. If the functional element is arranged point-symmetrically about the center of the substrate like the print element rows and drive circuits, the effect of the functional element may be decreased.

SUMMARY OF THE INVENTION

A print element substrate according to an aspect of the present invention includes: a print element row group including at least one or more print element rows each including multiple print elements that are aligned in a first direction and allow a liquid to be discharged, supply ports that allow the liquid to flow into the print element substrate from outside, collection ports that allow the liquid to flow out to the outside, and drive circuits that drive the print elements, the print element rows being arranged in a second direction crossing the first direction, in which in a layer including the print elements and a layer below the layer including the print elements in a lamination direction of the print element substrate, the print elements and the drive circuits are arranged point-symmetrically about the center of the substrate viewed from a side where discharge ports that allow the liquid to be discharged are open, and in an upper layer over the layer including the print elements in the lamination direction, functional elements are arranged in a direction of liquid flow in which the liquid flows from the supply ports to the collection ports while passing above the print elements.

Further features of the present invention will become apparent from the following description of exemplary embodiments with reference to the attached drawings.

DESCRIPTION OF THE EMBODIMENTS

Figure 1:
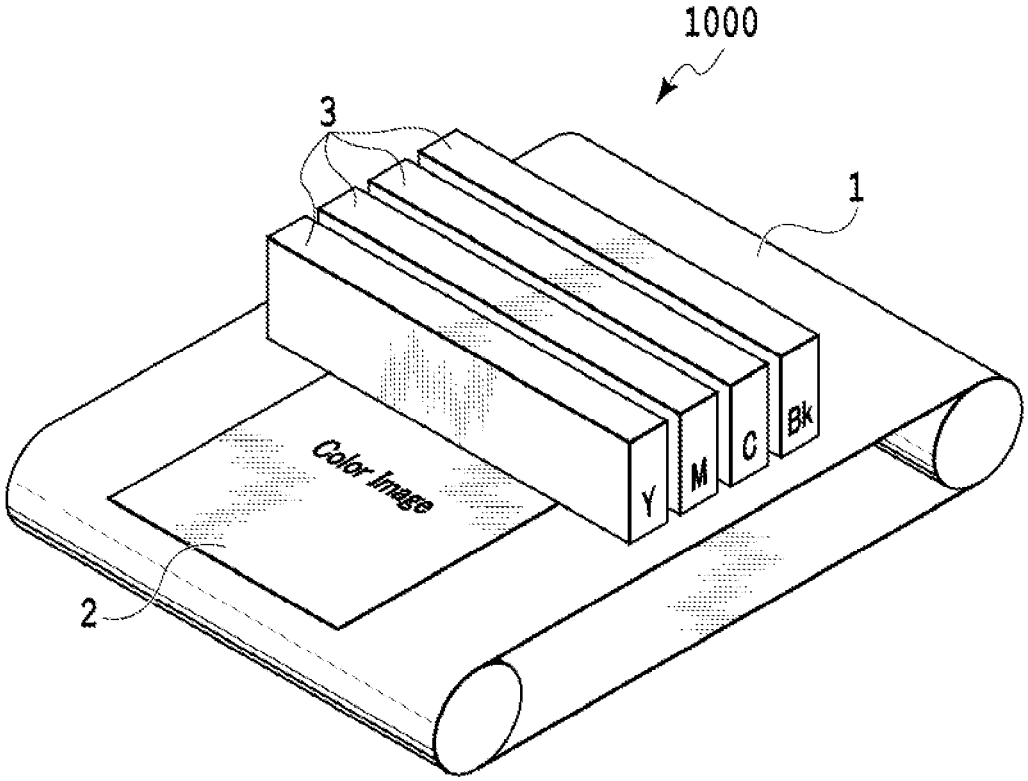
FIG. 1 is a diagram that illustrates a schematic configuration of a liquid discharge apparatus.

Embodiments of the present invention are described below with reference to the drawings. The following embodiments are not intended to limit the present invention, and all the combinations of features described in the embodiments are not necessarily required for the solution from the present invention. The same configurations are described using the same reference numerals. The relative arrangements, shapes, and the like of the constituents described in the embodiments are merely examples and are not intended to limit the scope of the invention to only those examples.

Embodiment 1

<Description of Liquid Discharge Apparatus>

A liquid discharge apparatus and a print element substrate used in the liquid discharge apparatus according to this embodiment are described below. The liquid discharge apparatus of this embodiment is, for example, an inkjet print apparatus. The liquid discharge apparatus includes a liquid discharge head for discharging a liquid. A thermal inkjet method is applied as a liquid discharge method of the liquid discharge head of this embodiment. The thermal inkjet method is a liquid discharge method that uses bubbling of the liquid (ink) for discharging liquid drops, the bubbling being induced by heat energy generated by applying power to an element formed of a heating resistor contacting the liquid for about several μ seconds. An example of using ink as the liquid is described below; however, it is not limited thereto.

FIG. 1 is a diagram that illustrates a schematic configuration of a liquid discharge apparatus 1000. The liquid discharge apparatus 1000 includes a transfer unit 1 that transfers a printed medium 2 and line-type liquid discharge heads 3 that are arranged substantially orthogonal to a transfer direction of the printed medium 2. The liquid discharge apparatus 1000 is a line-type liquid discharge apparatus that performs continuous printing in one path while transferring multiple printed media 2 continuously or intermittently.

The printed media 2 may not be limited to cut paper sheets and may be a continuous sheet. The liquid discharge apparatus 1000 includes the liquid discharge heads 3 for four single colors respectively corresponding to four kinds of inks of CMYK (cyan, magenta, yellow, and black).

Figure 2:
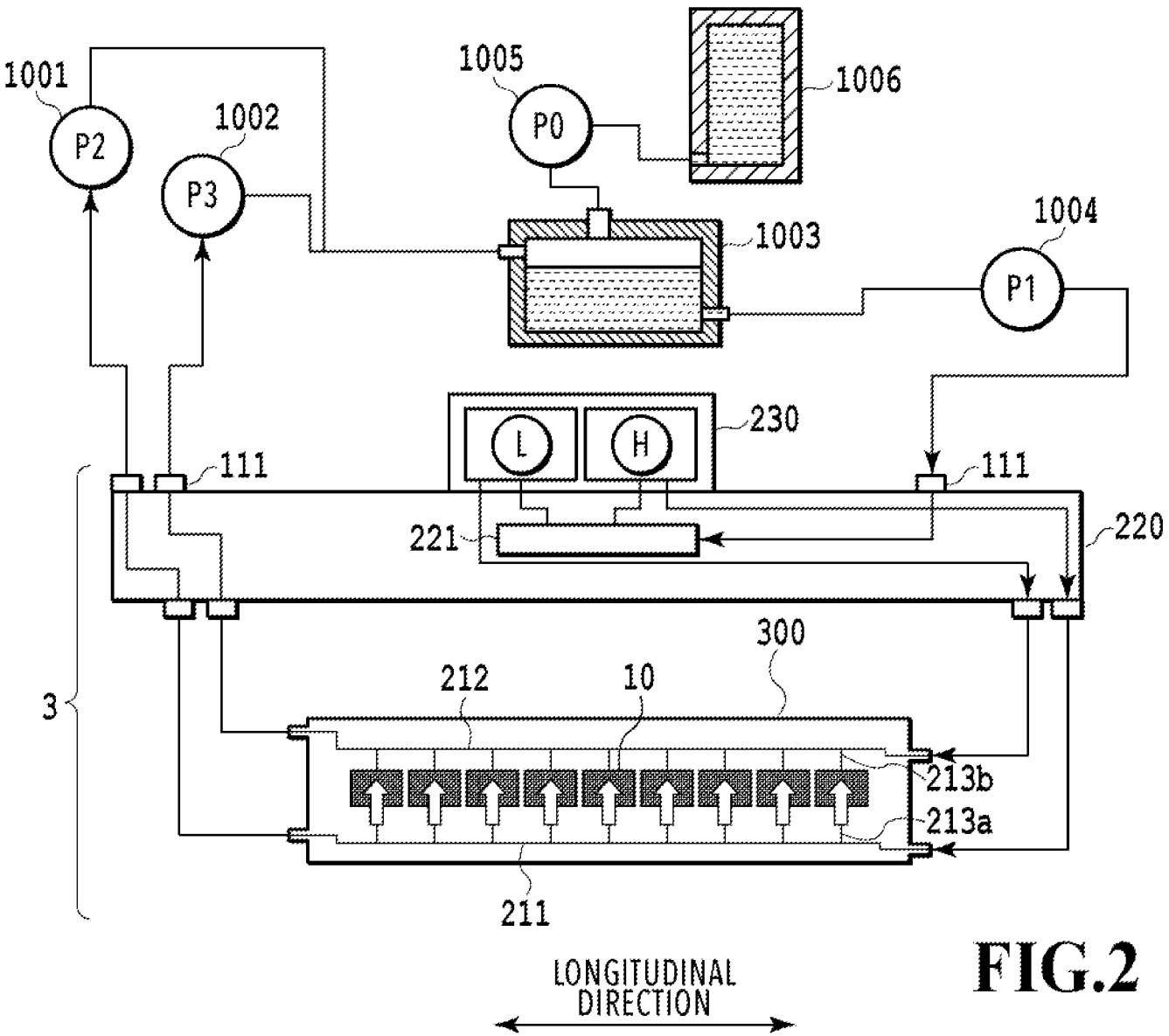
FIG. 2 is a diagram that illustrates a mode of a circulation route applied to the liquid discharge apparatus.

FIG. 2 is a schematic diagram that illustrates a mode of a circulation route applied to the liquid discharge apparatus of this embodiment. FIG. 2 is a diagram that illustrates fluid connections of each of the liquid discharge heads 3, a first circulation pump (high pressure side) 1001, a first circulation pump (low pressure side) 1002, a buffer tank 1003, and the like. For the sake of simplicity, FIG. 2 illustrates a route through which an ink of one color out of the CMYK inks flows only; however, actually, circulation routes of the four colors are provided in the main body of the liquid discharge apparatus. The buffer tank 1003, which is a sub tank connected with a main tank 1006, stores the ink. The buffer tank 1003 includes an (unillustrated) air communication port that allows for the communication between the inside and the outside of the tank to discharge air bubbles in the ink to the outside. The buffer tank 1003 is also connected with a replenishment pump 1005. In a case where the ink is consumed in the liquid discharge head 3 because the ink is discharged from a discharge port of the liquid discharge head, such as a case of printing or suction recovering, the replenishment pump 1005 transfers the consumed amount of the ink from the main tank 1006 to the buffer tank 1003.

A negative-pressure control unit 230 is provided in a route between a second circulation pump 1004 and a discharge unit 300. The negative-pressure control unit 230 has a function of operating to maintain a pressure downstream of the negative-pressure control unit 230 (i.e., discharge unit 300 side) to a constant pressure set in advance even in a case where a flow rate of the circulation system is varied depending on the difference of Duty of printing.

The discharge unit 300 is provided with a common supply flow path 211, a common collection flow path 212, and pairs of a separate supply flow path 213*a* and a separate collection flow path 213*b* communicated with each of print element substrates 10. The separate supply flow paths 213*a* are communicated with the common supply flow path 211, and the separate collection flow paths 213*b* are communicated with the common collection flow path 212. Thus, there are flows (arrows in FIG. 2) of a part of the ink that flows from the common supply flow path 211 and passes through flow paths in the print element substrates 10 to flow into the common collection flow path 212. This is because a differential pressure is generated between the two common flow paths with a pressure adjustment mechanism H connected to the common supply flow path 211 and a pressure adjustment mechanism L connected to the common collection flow path 212. A supply unit 220 is provided with liquid connection units 111. A filter 221 is provided inside the supply unit 220 for removing foreign substances in the supplied ink.

<Description of Discharge Unit>

Figure 3:
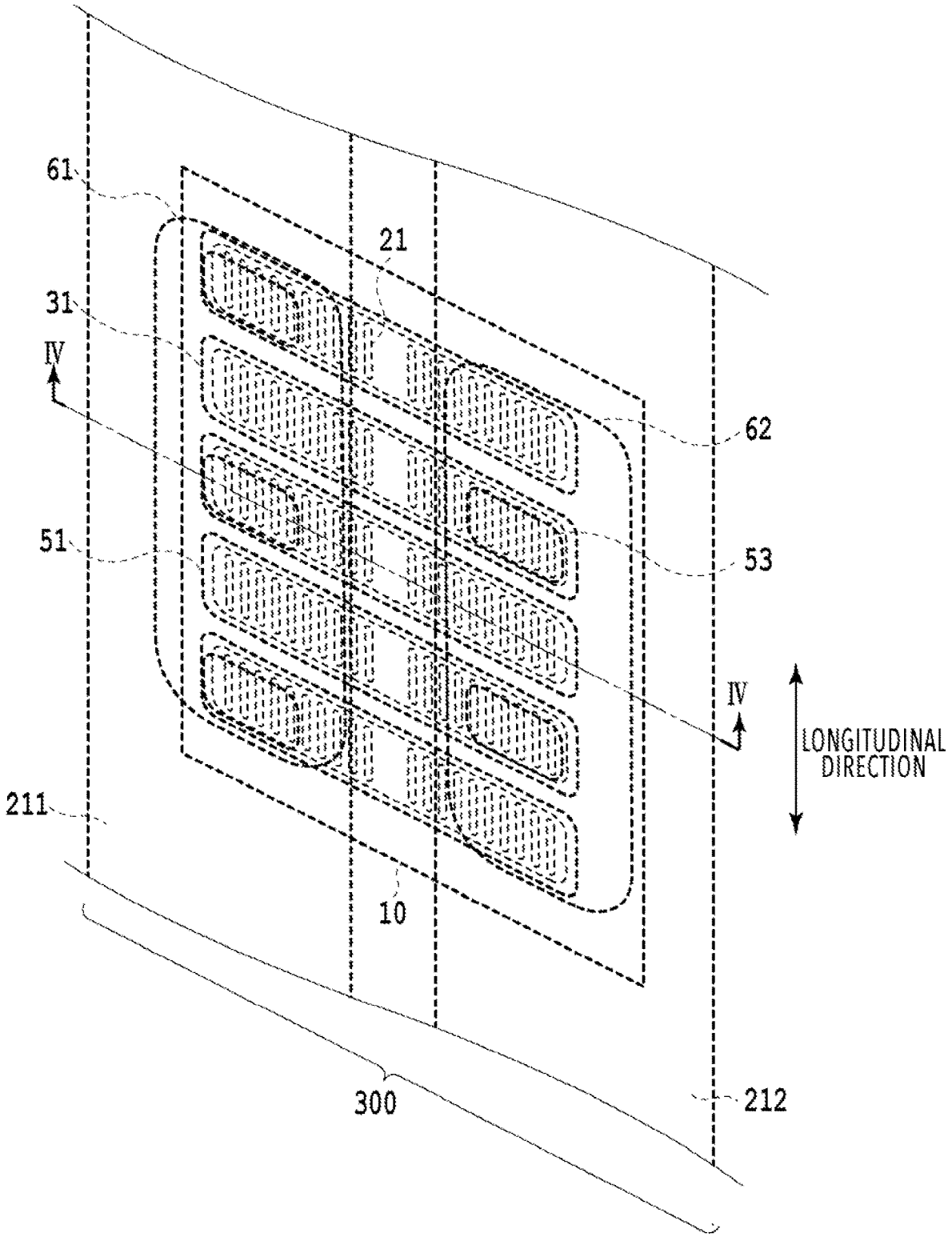
FIG. 3 is a transparent view that illustrates connection relationships in a discharge unit.

FIG. 3 is a transparent view that illustrates connection relationships in the discharge unit 300 in which the common supply flow path 211 and the common collection flow path 212 connected to the print element substrates 10 are formed.

Figure 4:
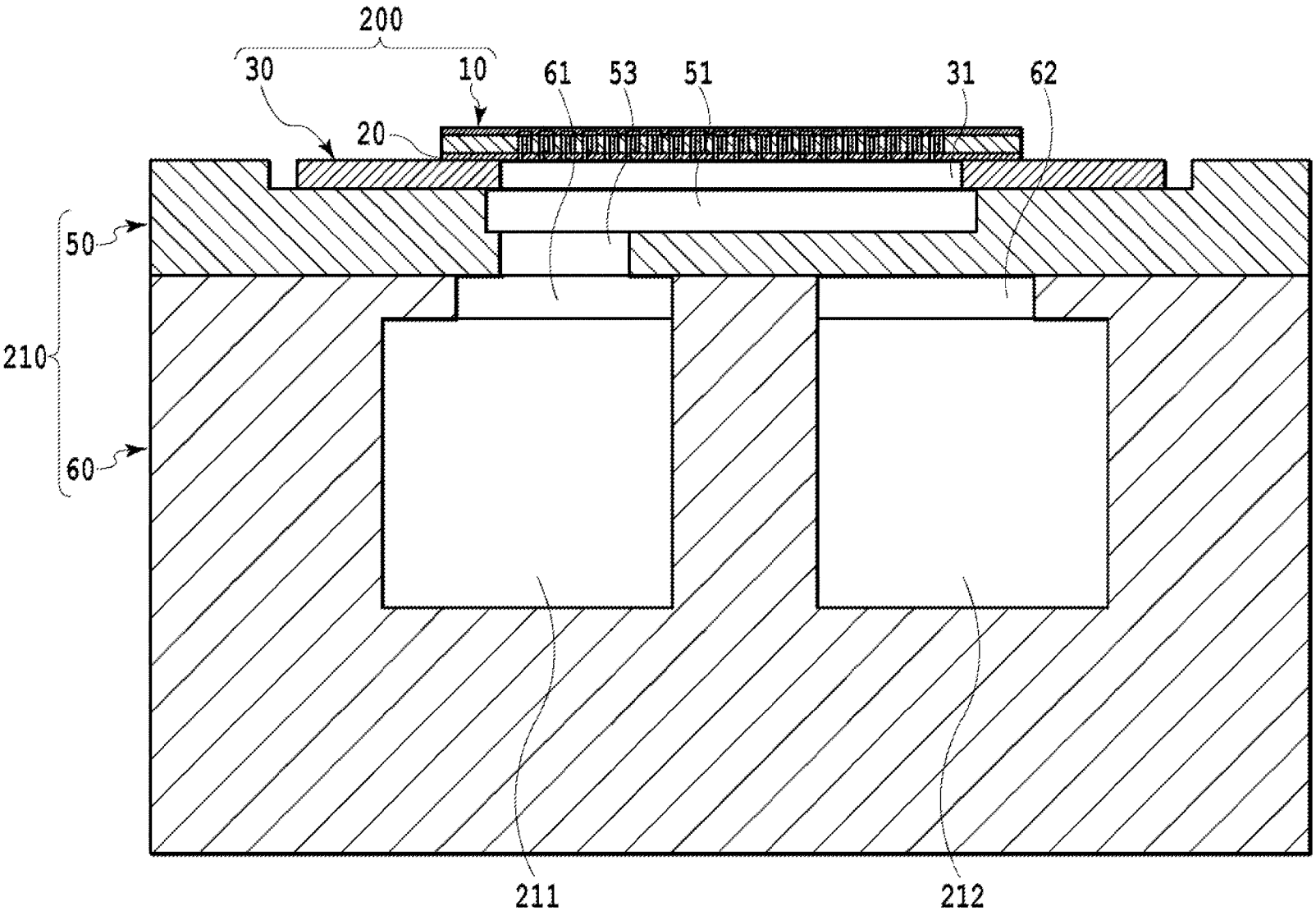
FIG. 4 is a diagram that illustrates a section taken along the IV-IV line in FIG. 3.

FIG. 4 is a diagram that illustrates a section taken along the IV-IV line in FIG. 3. The connection relationships in the discharge unit 300 are described with reference to FIGS. 3 and 4. As illustrated in FIG. 3, a pair of the common supply flow path 211 and the common collection flow path 212 extending in a longitudinal direction of the liquid discharge head 3 is provided in the discharge unit 300. A back-surface flow path member 210 including the common supply flow path 211 and the common collection flow path 212 is formed of a first flow path member 50 and a second flow path member 60 as illustrated in the cross-sectional view of FIG. 4. A communication port 61 in the second flow path member 60 and separate communication ports 53 in the first flow path member 50 are connected with each other while adjusting their positions. A supply route is formed that allows for communications between the communication port 61 in the second flow path member 60, the common supply flow path 211, and communication ports 51 in the first flow path member 50. Likewise, a collection route is formed as well that allows for communications between a communication port 62 in the second flow path member 60, the common collection flow path 212, and the communication ports 51 in the first flow path member 50.

As illustrated in FIG. 4, the common supply flow path 211 is connected to a discharge module 200 through the communication port 61, the separate communication ports 53, and the communication ports 51. The discharge module 200 includes the print element substrate 10 and a support member 30 supporting the substrate. Each of the separate supply flow paths 213*a* (FIG. 2) includes the communication port 61, the separate communication ports 53, and the communication ports 51. Likewise, each of the separate collection flow paths 213*b* includes the communication port 62, the separate communication ports 53, and the communication ports 51 in a (unillustrated) section different from the section in FIG. 3. The discharge unit 300 includes multiple pieces of the discharge module 200 and the single back-surface flow path member 210 (combination of the first and second flow path members 50 and 60). The support member 30 is provided with liquid communication ports 31, and a lid member 20 is provided with openings 21 communicated with the liquid communication ports 31 in the support member 30.

<Description of Discharge Module>

Figure 5:
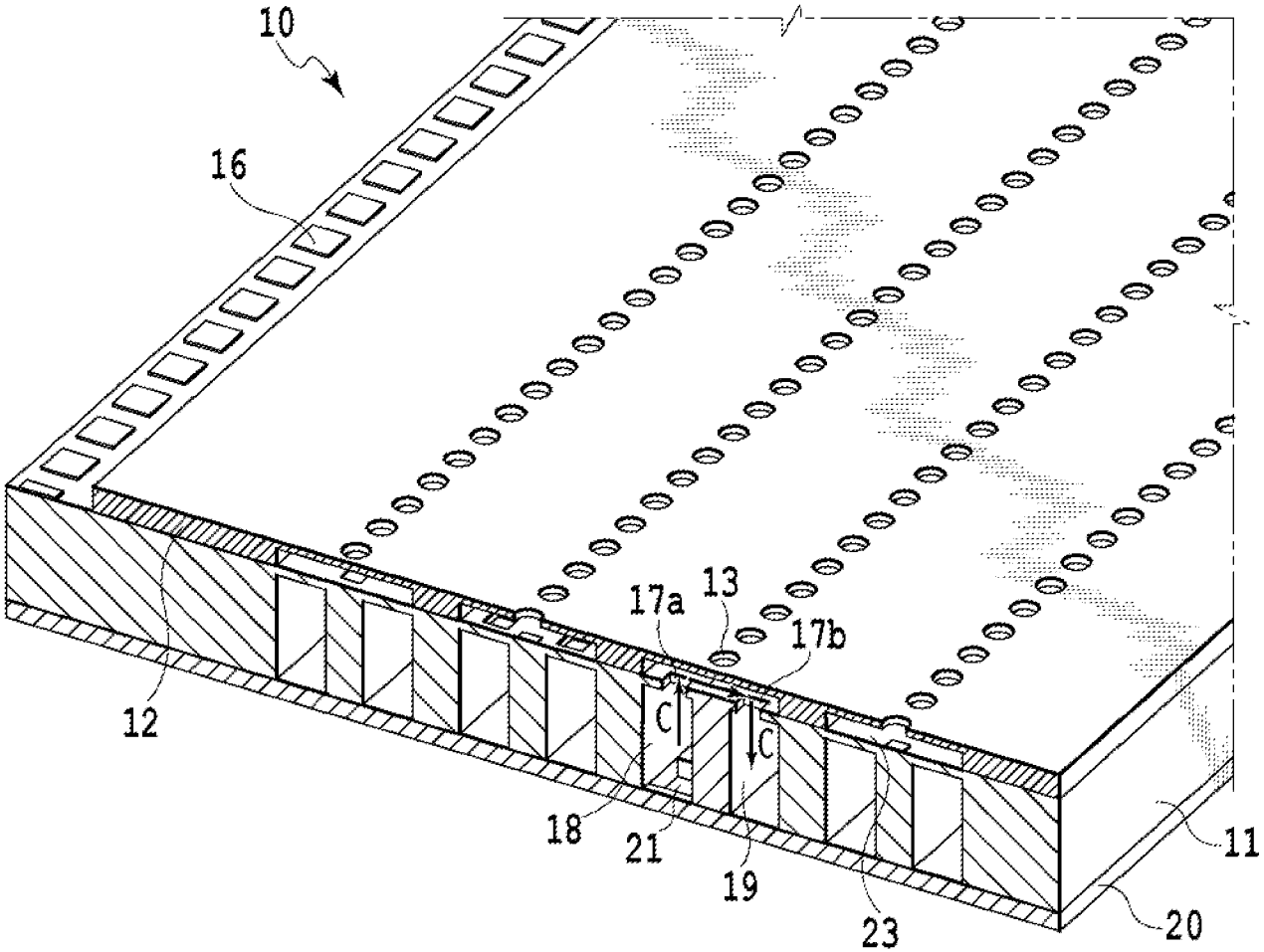
FIG. 5 is a diagram that illustrates a perspective view of a periphery of a discharge module.

FIG. 5 is a perspective view of a periphery of the discharge module 200 including the print element substrate 10. The print element substrate 10 includes a substrate 11 formed of multiple layers laminated on a silicon substrate, a discharge port formation member 12 made of photopolymer, and the lid member 20 attached on a back surface of the substrate 11. In the discharge port formation member 12 of the print element substrate 10, discharge port rows each including aligned multiple discharge ports 13 are formed. Hereinafter, a direction in which the discharge port rows each including the aligned multiple discharge ports 13 extend is referred to as a "discharge port row direction." Print elements 131 (see later-described FIG. 8C) are formed on the substrate 11. The print elements 131 are elements formed of thermal resistors that generate the energy used for discharging the liquid.

As illustrated in FIG. 5, grooves including liquid supply paths 18 and liquid collection paths 19 extending along the discharge port row direction are formed in the back-surface side of the substrate 11 (opposite of the side including the discharge ports 13). One of two sides of each discharge port row is provided with a supply port 17*a*, and the other is provided with a collection port 17*b*. The supply ports 17*a* and the collection ports 17*b* are alternately provided in a direction crossing the discharge port row direction.

Flow paths that are respectively communicated with the discharge ports 13 are formed in the print element substrate 10 to allow a part or all of the supplied ink to be circulated while flowing through the discharge ports 13 (pressure chambers 23) suspending the discharge operation. As illustrated in FIG. 2, the common supply flow path 211 is connected with the negative-pressure control unit 230 (high pressure side) through the supply unit 220, and the common collection flow path 212 is connected with the negative-pressure control unit 230 (low pressure side) through the supply unit 220. The differential pressure generates a flow from the common supply flow path 211 to the common collection flow path 212 though the discharge ports 13 (pressure chambers 23) of the print element substrate 10. As a result, in the print element substrate 10, the liquid flows therein from the outside through the supply ports 17*a*, and the liquid passed through the pressure chambers 23 flows out to the outside through the collection ports 17*b*. That is, the liquid discharge head 3 includes the pressure chambers 23 in which the print elements 131 are provided, and the liquid in the pressure chambers is configured to be circulatable between the inside and the outside of the pressure chambers 23.

<Description of Print Element Substrate>

Figure 8A:
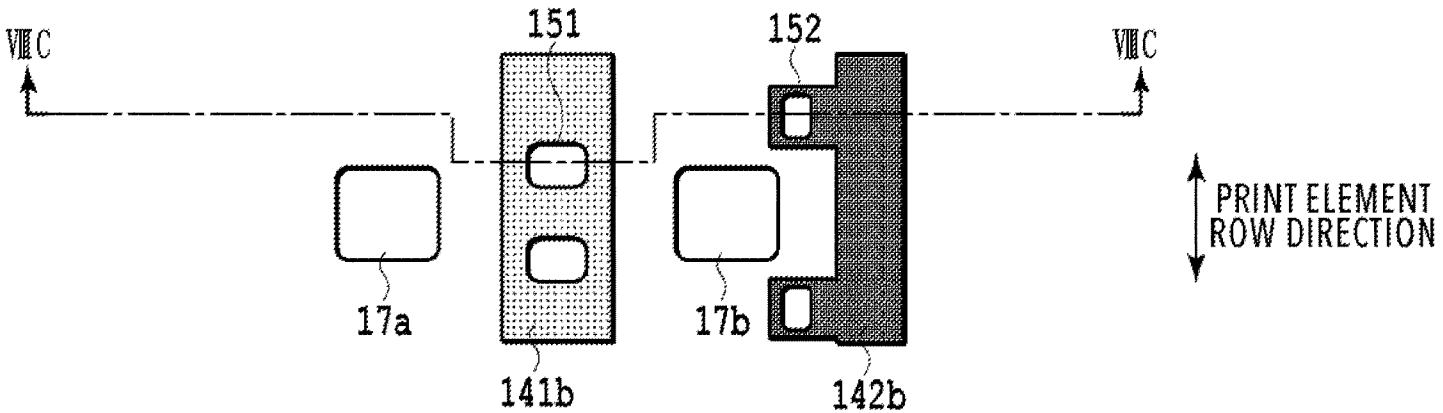
FIG. 8A is a diagram that illustrates a plan view of a periphery of the print elements in a first region.
Figure 8B:
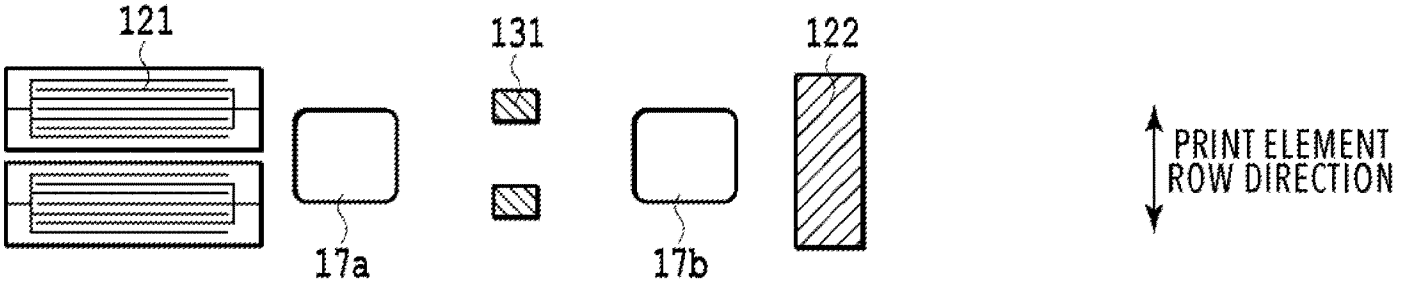
FIG. 8B is a diagram that illustrates a plan view of a periphery of the print elements in the first region.
Figure 8C:
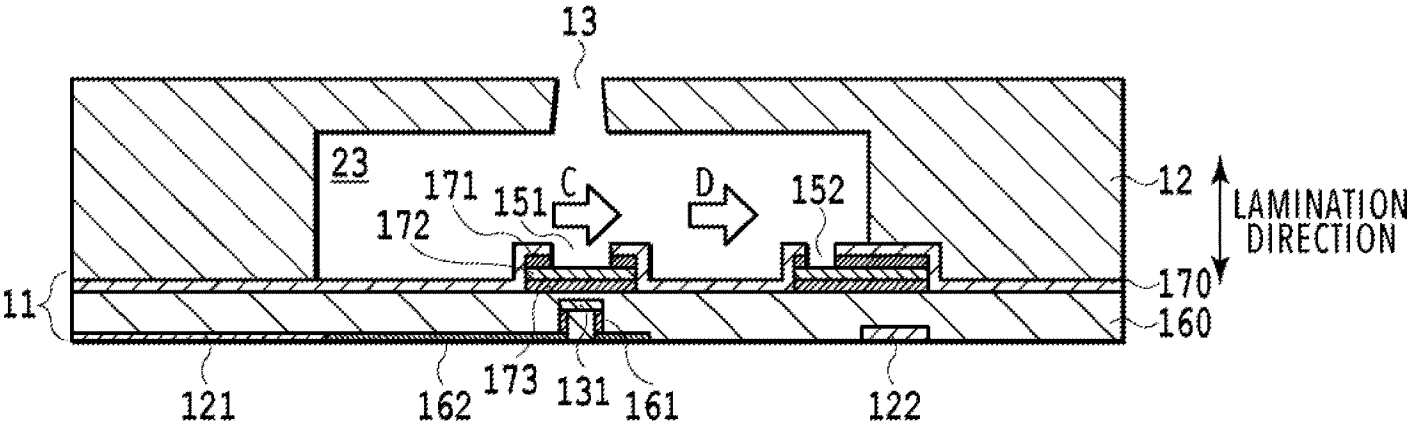
FIG. 8C is a diagram that illustrates a cross-sectional view of a periphery of the print elements in the first region.

FIGS. 8A to 8C are diagrams that illustrate a periphery of the print elements 131 on the substrate 11 of the print element substrate 10. Although FIG. 8C is a drawing used for the later description, FIG. 8C is temporarily referred to herein for describing the print element substrate 10 (substrate 11). FIG. 8C is a cross-sectional view of the periphery of the print elements 131 on the substrate 11.

In this specification, descriptions are given while defining a side of a discharge port surface in which the discharge ports 13 are provided as "top" and defining a side of a back surface of the discharge port surface, or a side of the silicon substrate, as "bottom" in a lamination direction of the print element substrates 10. The print elements are arranged on the top of the silicon substrate.

An insulation layer 160 is arranged on the thermal resistors (print elements 131) formed on the print element substrate 10 (substrate 11) so as to cover the thermal resistors. In other words, the insulation layer 160 is arranged immediately above the print elements 131 in the lamination direction. The insulation layer 160 is formed of, for example, a SiO membrane, SiN membrane, or the like. The ink is discharged by heating the thermal resistors based on a pulse signal inputted from a (unillustrated) control circuit of the liquid discharge apparatus to cause the ink (liquid) to be heated and boiled. In this case, a physical effect such as an impact caused by cavitation generated in bubbling, shrinking, and bubble-fading of the ink may be exerted on a region on the thermal resistors. In order to protect the thermal resistors from such a physical effect on the thermal resistors, protection layers made of a metal material and the like are arranged on the thermal resistors to cover the thermal resistors. Two layers including a first protection layer 173 and a second protection layer 172 are arranged as the protection layers on the insulation layer 160. These protection layers have a function of protecting surfaces of the print elements 131 formed of the thermal resistors from a chemical impact and physical impact caused by the heating of the thermal resistors. For example, the first protection layer 173 is made of tantalum (Ta), and the second protection layer 172 is made of iridium (Ir). The protection layers made of those materials have conductivity. The conductive substance forming the protection layers may be an alloy including tantalum (Ta), iridium (Ir), and aluminum (Al).

A first adhesive layer 171 and a second adhesive layer 170 are arranged on the second protection layer 172. The first adhesive layer 171 has a function of improving the adherence between the second protection layer 172 and another layer. The first adhesive layer 171 is made of, for example, tantalum (Ta). The second adhesive layer 170 has a function of protecting another layer from the liquid and improving the adherence between another layer and the discharge port formation member 12. The second adhesive layer 170 is made of, for example, SiC and SiCN.

The discharge port formation member 12 is attached on a second adhesive layer 170 surface of the substrate 11 and forms flow paths including corresponding pressure chambers 23 between the discharge port formation member 12 and the substrate 11. Each flow path is a region including the supply port 17*a* and the collection port 17*b* that is surrounded by the discharge port formation member 12 and the substrate 11. The discharge port formation member 12 includes (unillustrated) partition walls between the discharge port formation member 12 and adjacent thermal action portions, and these partition walls form the sections of the pressure chambers 23.

For discharging the ink, on the thermal action portions contacted with the ink, the temperature of the ink is immediately increased, the ink is bubbled, the bubble fades away, and cavitation occurs. For this reason, the second protection layer 172 covering the thermal action portions is made of iridium that has high corrosion resistance and high cavitation resistance.

<Description of Plane Pattern>

Figure 6:
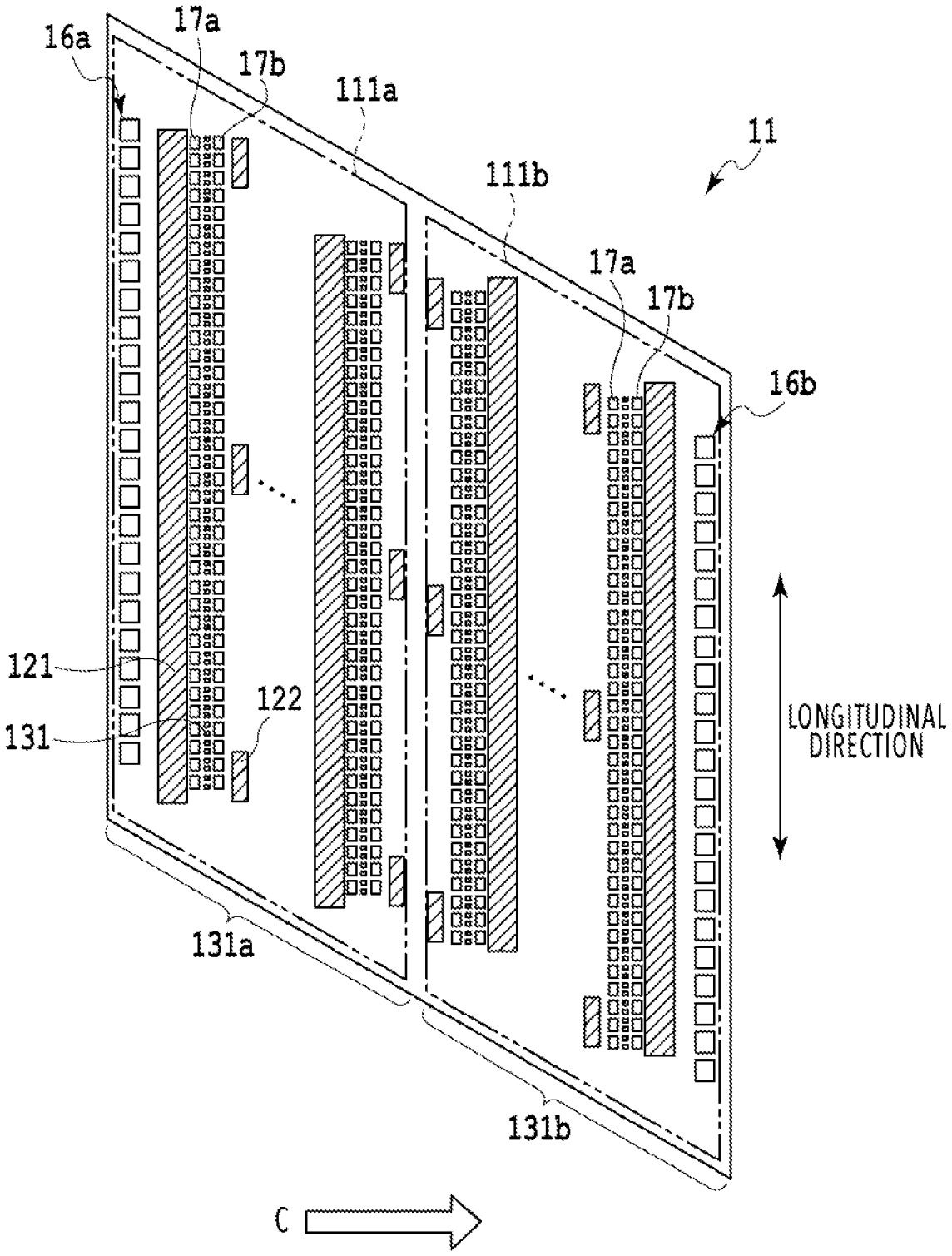
FIG. 6 is a substrate plan view that illustrates a configuration of a layer including print elements or a lower layer below the layer including the print elements.

FIG. 6 is a diagram that illustrates a plane configuration of the substrate 11 in a plan view. That is, FIG. 6 is a diagram of the substrate 11 viewed from a side where the discharge ports are open. FIG. 6 is a diagram that illustrates a plane layout of a layer including the print elements 131 or a lower layer below the layer including the print elements 131 (i.e., a layer including or below the print elements) in the lamination direction. As illustrated in FIG. 6, a first region 111*a* and a second region 111*b* are provided on the substrate 11. External connection terminal aligned rows 16*a* and 16*b* are respectively arranged at ends of the substrate within the corresponding regions. The external connection terminal aligned rows 16*a* and 16*b* are electrically connected with print element row groups 131*a* and 131*b* arranged in the first region 111*a* and the second region 111*b* indicated by dashed double-dotted lines, respectively. The print element row groups 131*a* and 131*b* each includes the print elements 131, the supply ports 17*a*, the collection ports 17*b*, the drive circuits 121, and temperature detection elements 122. A vertical direction of FIG. 6 corresponds to the longitudinal direction of FIG. 3. The vertical direction of FIG. 6 is referred to as a print element row direction, the discharge port row direction, or a first direction. As illustrated in FIG. 6, the external connection terminal aligned rows 16*a* and 16*b*, the print elements 131, the drive circuits 121 driving the print elements, and the temperature detection elements 122 are arranged point-symmetrically about the center of the substrate. This point-symmetric arrangement about the center of the substrate makes it possible to achieve reduction of the layout design load while inhibiting size increase of the print element substrate 10. Any arrangement may be applied as long as at least the print elements 131 and the drive circuits 121 are arranged point-symmetrically about the center of the substrate. The point-symmetric arrangement herein includes substantially point-symmetric arrangement that allows the print elements and the drive elements not contributing to the printing and dummy external connection terminals not being connected with wirings to be arranged in an empty space of either the first or second region. Even with such arrangement of the elements and terminals, it is still possible to reduce the layout design load. Such point-symmetric arrangement is preferred; however, the layout design load can also be reduced by arranging the rows of the print elements 131 and the drive circuits 121 in the opposite order in a second direction between the first region 111*a* and the second region 111*b*.

Meanwhile, in the first region 111*a* and the second region 111*b*, the supply ports 17*a* and the collection ports 17*b* are not arranged point-symmetrically about the center of the substrate. This is because of the following reason. Because of the configurations of the common supply flow path 211 and the common collection flow path 212 attached with the print element substrate 10 as illustrated in FIGS. 3 and 4, the ink flows from the common supply flow path 211 close to the first region 111*a* to the common collection flow path 212 close to the second region 111*b*. Thus, ink circulation directions C in the first region 111*a* and the second region 111*b* are the same direction. For this reason, the supply ports 17*a* and the collection ports 17*b* are not arranged point-symmetrically.

In this embodiment, functional elements that affect the ink flowing through the print element substrate are arranged. Details of the functional elements are described later. Here, a case is simulated where the functional elements are arranged point-symmetrically about the center of the substrate like the print element rows and the drive circuits. As described above, the ink circulation directions C in the first region 111*a* and the second region 111*b* are the same direction. Thus, effects of the functional elements in one region (e.g., first region 111*a*) can be maintained, but effects of the functional elements in the other region (e.g., second region 111*b*) are reduced. For the sake of easy understanding, first, a comparative example of the case where the functional elements are arranged point-symmetrically about the center of the substrate is described below. Thereafter, the configuration of this embodiment is described.

<Description of Comparative Example>

Figure 7:
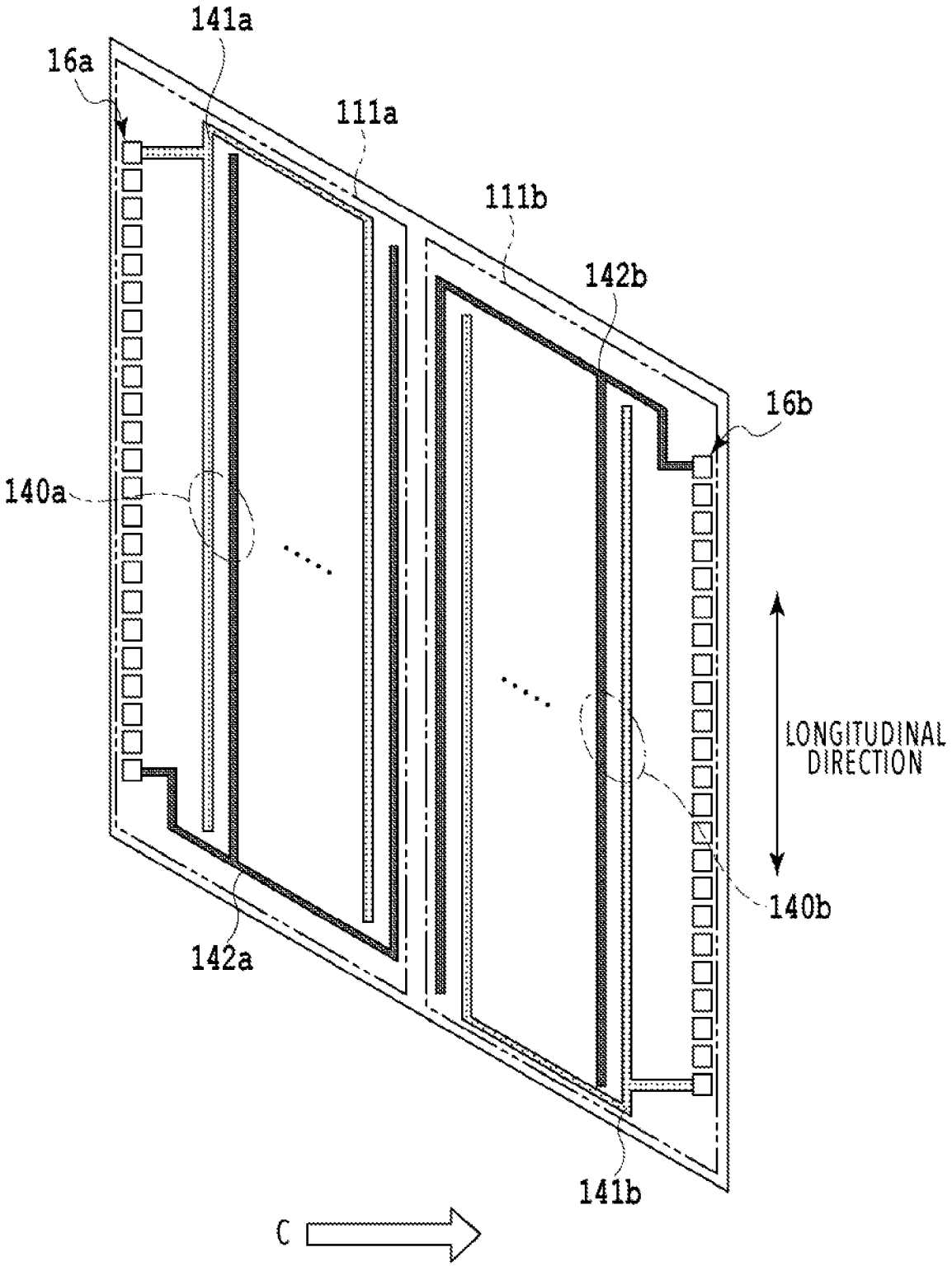
FIG. 7 is a substrate plan view that illustrates a configuration of an upper layer over the layer including the print elements.

FIG. 7 is a diagram that illustrates a plane configuration of the substrate 11 as the comparative example. FIG. 7 is a diagram that illustrates a plane layout of an upper layer (discharge port side) over the layer including the print elements 131 in the lamination direction. That is, FIG. 7 is a diagram that includes plane patterns of the first adhesive layer 171 and the second protection layer 172 that are upper layers over the layer including the print elements 131 in the substrate 11. The functional elements of this embodiment are functional elements formed in a wiring pattern of the conductive substance, which are a protection layer pattern including first electrodes and a protection layer pattern including second electrodes. The reason of using those functional elements is described.

In the case where the thermal resistors are heated, in the thermal action portions contacted with the ink, color materials and additives included in the ink may be decomposed at the molecular level by the high-temperature heating, changed to low-soluble substances, and physically adhered on the thermal action portions. This phenomenon is called "kogation," and in a case where low-soluble organic substances and inorganic substances are adhered on the thermal action portions of the protection layer, thermal conduction from the thermal action portions to the liquid becomes inhomogeneous and bubbling becomes unstable. The following method may be applied as a countermeasure for the kogation. The first electrodes including the thermal action portions and the second electrodes different from the first electrodes are provided in the pressure chamber 23. Then, an electric field is generated in the ink in the pressure chamber 23 by applying voltages to the two kinds of electrodes to keep away charged colloid particles from the thermal action portions. In this way, kogation generation preventive processing is performed.

In the comparative example, as the electrodes for generating the electric field in the ink, two patterns including the protection layers are arranged in the periphery of the print elements 131 electrically connected with the external connection terminals in the external connection terminal aligned rows 16*a* and 16*b*. First patterns are first electrode wiring patterns 141*a* and 141*b* formed of the first protection layer 173 and the second protection layer 172 covering the surfaces of the print elements 131. Second patterns are second electrode wiring patterns 142*a* and 142*b* formed of the first protection layer 173 and the second protection layer 172. The electric field is formed in the ink by applying voltages between the first and second electrodes so that the charged particles (pigment particles) such as the color materials included in the ink are repelled from the periphery of the print elements (first electrodes). That is, the electric field is formed such that the first electrodes have the same polarity as that of the charged particles in the ink and the second electrodes have the opposite polarity of the first electrodes. For reducing load in a production step, the material forming the electrodes is preferably made of the same material as that of the second protection layers (iridium).

In the comparative example, a mode of applying a plane layout for the substrate size increase inhibition and design load reduction in the case of using the abovementioned functional elements is described. In FIGS. 6 and 7, the plane layouts for the substrate size increase inhibition and design load reduction are made. For example, as described in FIG. 6, the print element row group 131*a* and the external connection terminal aligned rows 16*a* and the print element row group 131*b* and the external connection terminal aligned rows 16*b* respectively arranged in the first region 111*a* and the second region 111*b* are arranged point-symmetrically about the center of the substrate. As illustrated in FIG. 7, the first electrode wiring patterns 141*a* and 141*b* and the second electrode wiring patterns 142*a* and 142*b* are also arranged point-symmetrically about the center of the substrate since they are connected with the terminals in the external connection terminal aligned rows 16*a* and 16*b*. The first electrode wiring patterns 141*a* and 141*b* and the second electrode wiring patterns 142*a* and 142*b* are electrically independent from each other.

FIGS. 8A to 8C are diagrams that illustrate planes and a section of a print element periphery 140*a* in the first region 111*a* of FIG. 7. FIG. 8A is a plan view that illustrates a configuration of the upper layer over the layer including the print elements 131 in the print element periphery 140*a* in the first region 111*a* of FIG. 7. FIG. 8B is a plan view that illustrates a configuration of the layer including the print elements 131 or the lower layer below the layer including the print elements 131 in the print element periphery 140*a* in the first region 111*a* of FIG. 7. FIG. 8C is a cross-sectional view of the VIIIC-VIIIC portion of FIG. 8A. FIG. 8A does not illustrate the second adhesive layer 170, and other plan views like FIG. 8A for describing the configuration of the upper layer over the layer including the print elements 131 do not illustrate the second adhesive layer 170 as well.

As illustrated in FIGS. 6 to 8C, in the print element row group arranged in the first region 111*a*, the print elements 131, the supply ports 17*a*, the collection ports 17*b*, the drive circuits 121, the temperature detection elements 122, first electrodes 151, and second electrodes 152 are aligned in the print element row direction. As illustrated in FIGS. 8A and 8C, in the first region 111*a*, the first electrode 151 is arranged immediately above the print elements 131. The first electrodes 151 are arranged for the respective print elements. In the first region 111*a*, the second electrodes 152 are arranged in the periphery of the collection ports 17*b*. The second electrodes 152 are arranged in the flow path of the respective collection ports. The ink circulation direction C is the second direction crossing the print element row direction (first direction).

As illustrated in FIGS. 8A and 8B, in the first region 111*a*, arrangement is made in the following order in the ink circulation direction C (second direction). That is, in the ink circulation direction C, the drive circuits 121, the supply ports 17*a*, the print elements 131, the first electrodes 151, the collection ports 17*b*, the second electrodes 152, and the temperature detection elements 122 are arranged in this order.

As illustrated in FIG. 8C, the insulation layer 160 is formed to cover the print elements 131. The print elements 131 are connected with the drive circuits 121 through a plug 161 and a wiring layer 162. For the generation of the electric field in the ink, the first electrodes 151 and the second electrodes 152 are formed by forming openings in the first and second adhesive layers 171 and 170 and exposing the second protection layer 172 to the ink.

As described above, once voltages are applied between the first and second electrode patterns, the charged particles (pigment particles) such as the color materials included in the ink are repelled from the print element periphery (first electrode pattern) in a direction D. That is, the pigment particles repelling direction D is the same direction as the ink circulation direction C. Thus, in the first region 111*a*, the ink circulation direction C and the pigment particles repelling direction D extend along one another. As a result, the repelling force of the electric field and the inertial force from the ink flow in the directions extending along one another affect the charged particles. This makes it possible to effectively keep away the charged particles from the first electrodes 151 and to enhance the kogation preventive effect.

Figure 9A:
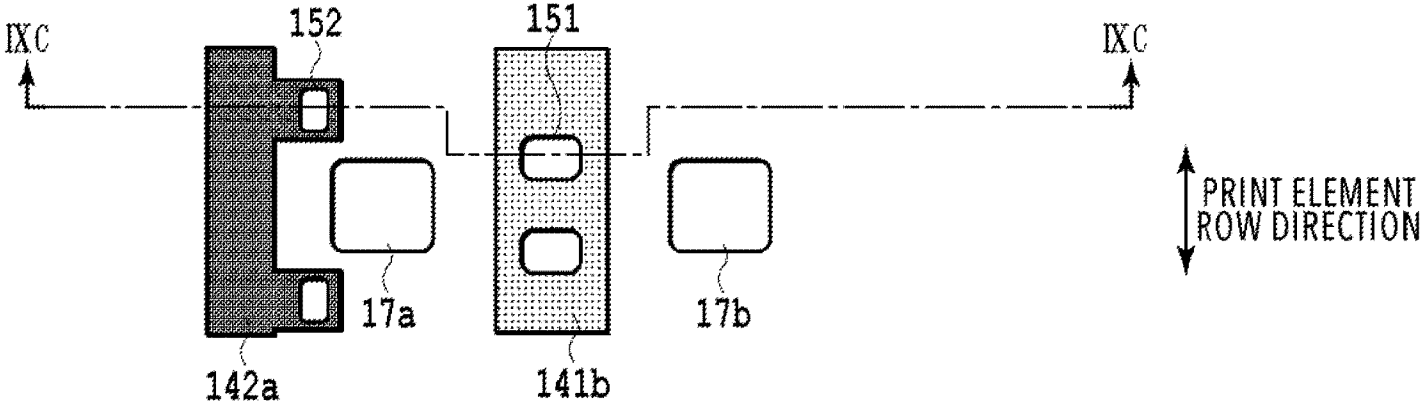
FIG. 9A is a diagram that illustrates a plan view of a periphery of the print elements in a second region.
Figure 9B:
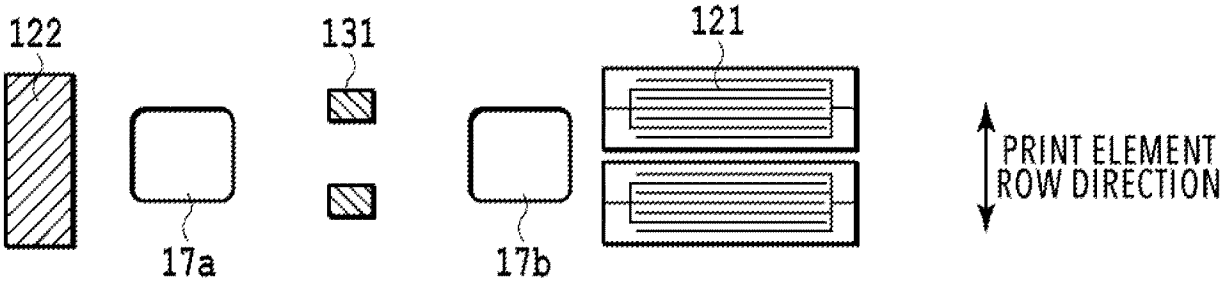
FIG. 9B is a diagram that illustrates a plan view of the periphery of the print elements in the second region.
Figure 9C:
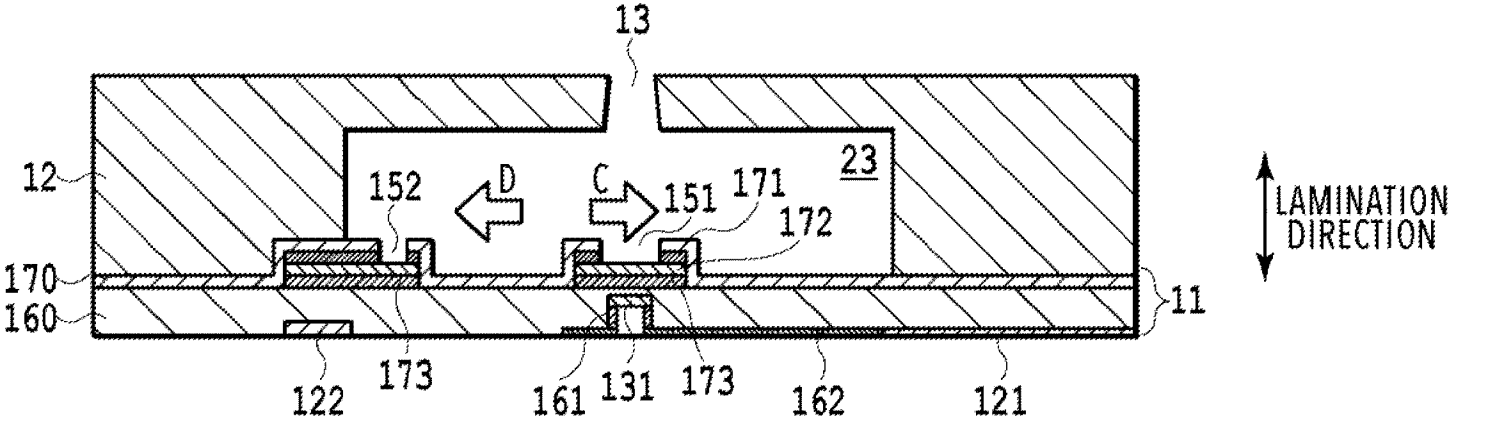
FIG. 9C is a diagram that illustrates a cross-sectional view of a periphery of the print elements in the second region.

FIGS. 9A to 9C are diagrams that illustrate planes and a section of a print element periphery 140*b* in the second region 111*b* of FIG. 7. FIG. 9A is a plan view that illustrates a configuration of the upper layer over the layer including the print elements 131 in the print element periphery 140*b* in the second region 111*b* of FIG. 7. FIG. 9B is a plan view that illustrates a configuration of the layer including the print elements 131 or the lower layer below the layer including the print elements 131 in the print element periphery 140*b* in the second region 111*b* of FIG. 7. FIG. 9C is a cross-sectional view of the IXC-IXC portion of FIG. 9A. The first electrodes 151, second electrodes 152, print elements 131, drive circuits 121, and the like in the second region 111*b* are arranged point-symmetrically to the first electrodes 151, second electrodes 152, print elements 131, drive circuits 121, and the like in the first region 111*a* about the center of the substrate. However, as illustrated in FIGS. 6, 8A to 9C, the supply ports 17*a* and the collection ports 17*b* are not arranged point-symmetrically about the center of the substrate between the first region 111*a* and the second region 111*b*. This is because, as illustrated in FIG. 3, the common supply flow path 211 is provided close to the first region 111*a* and the common collection flow path 212 is provided close to the second region 111*b* in the discharge module 200. This allows the ink to be circulated in the circulation direction C in FIG. 6. Thus, in FIG. 6, the supply ports 17*a* are arranged on the left of the print elements 131 and the collection ports 17*b* are arranged on the right of the print elements 131 in the second region 111*b* as well. Both the supply ports 17*a* and collection ports 17*b* are openings having the same shapes and dimensions, and the supply ports 17*a* and collection ports 17*b* are defined depending on directions of liquid flows through the openings. That is, in a state of the single print element substrate 10 before the liquid starts flowing, the print element row groups 131*a* and 131*b* including the openings of the supply ports 17*a* or the collection ports 17*b* are arranged point-symmetrically about the center of the substrate. However, once the print element substrate 10 is mounted in the discharge unit 300 and the liquid circulation direction (flow direction) is defined, the supply ports 17*a* and the collection ports 17*b* on the substrate are not arranged point-symmetrically.

In other words, in the comparative example illustrated in FIG. 7, the constituents such as the electrodes and print elements are point-symmetric about the center of the substrate, but the supply ports 17*a* and the collection ports 17*b* are not point-symmetric. That is, in the plan view of the print element substrate, the print elements and the drive circuits arranged closer to the silicon substrate than the print elements are arranged in the opposite order in the second direction between the first region 111*a* and the second region 111*b*. The supply ports 17*a* and the collection ports 17*b* are arranged in the same order in the second direction between the first region 111*a* and the second region 111*b*. Thus, the second region 111*b* differs from the first region 111*a* in that the second electrodes 152 generating the electric filed in the ink are arranged close to the supply ports 17*a*. This causes the direction D, in which the pigment particles repel from the print elements 131 due to the generation of the electric filed in the ink, to be opposite of the ink circulation direction C in the second region 111*b*. For this reason, the kogation preventive effect on the surfaces of the print elements 131 in the second region 111*b* is lower than that in the first region 111*a*.

The configuration of the flow path members may be changed and another configuration may be considered in which the ink circulation directions in the first region 111*a* and the second region 111*b* of the substrate 11 are also point-symmetric. However, in this case, the common supply flow path 211 and the common collection flow path 212 have to be provided in each of the first region 111*a* and the second region 111*b*, and this may cause size increase of the discharge unit 300 and increase of the design load. Since the ink discharge direction affects the ink circulation direction C, if the ink circulation directions are different between the first region 111*a* and the second region 111*b*, the ink discharge directions in the first region 111*a* and the second region 111*b* may become different. This may affect the printing quality. For this reason, it is difficult to arrange the second electrodes 152 close to the collection ports 17*b* in both the regions while changing the ink circulation directions in the substrate 11 and arranging all the patterns point-symmetrically on the substrate 11.

The example of a plane layout of the embodiment described below is an example of providing a print element substrate with improved printing quality while achieving efficiency of the layout design and preventing kogation on surfaces of print elements.

<Description of Plane Layout of Embodiment 1>

Figure 10:
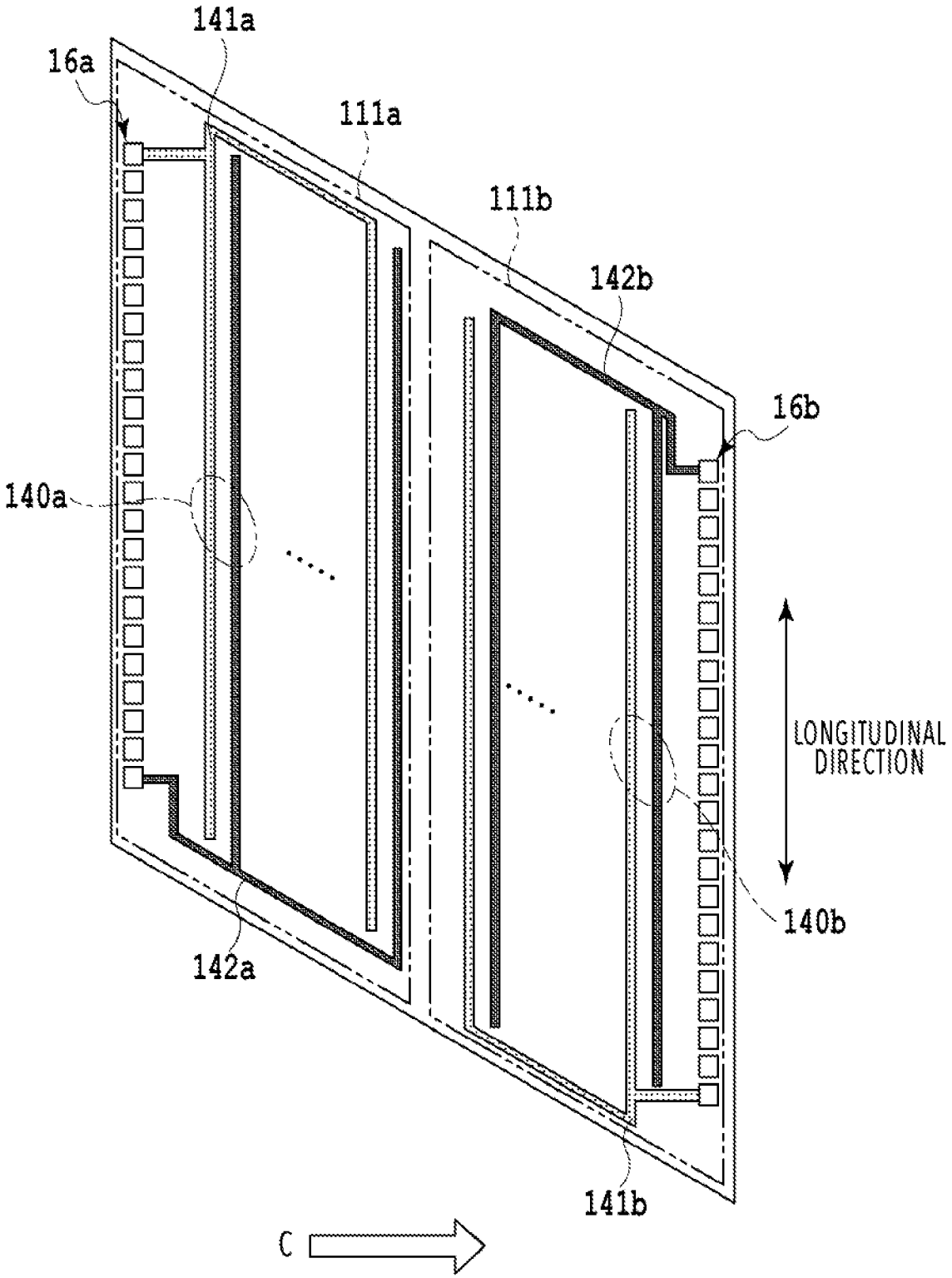
FIG. 10 is a diagram that illustrates plane patterns in the upper layer over the layer including the print elements.

FIG. 10 is a diagram that includes plane patterns of the first adhesive layer 171 and the second protection layer 172 in the upper layer over the layer including the print elements 131 of the substrate 11 in Embodiment 1. The plane pattern of the first region 111*a* is the same as the plane pattern described in the comparative example of FIG. 7. In this embodiment, the first electrode wiring pattern 141*b* in the second region 111*b* is not point-symmetric to the first electrode wiring pattern 141*a* in the first region 111*a* about the center of the substrate, and the second electrode wiring pattern 142*b* in the second region 111*b* is not point-symmetric to the second electrode wiring pattern 142*a* in the first region 111*a* about the center of the substrate.

Figure 11A:
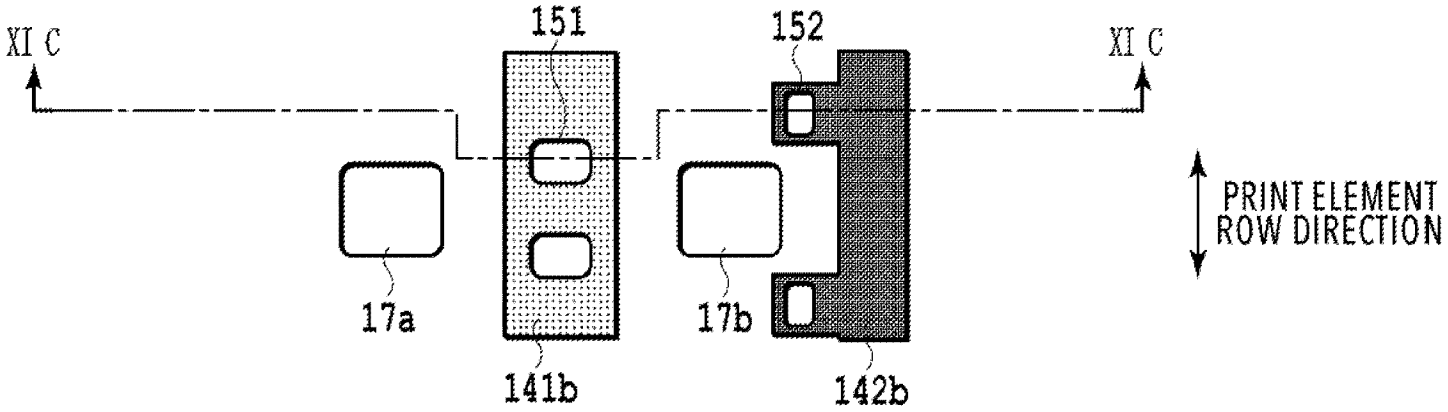
FIG. 11A is a diagram that illustrates a plan view of the periphery of the print elements in the second region.
Figure 11B:
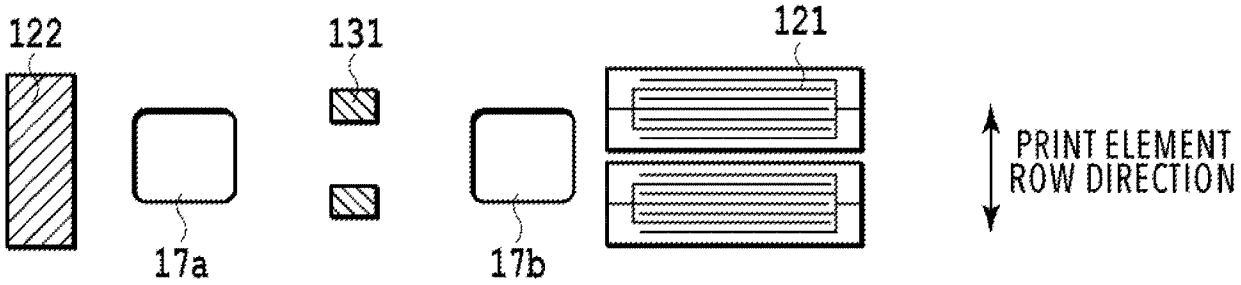
FIG. 11B is a diagram that illustrates a plan view of the periphery of the print elements in the second region.
Figure 11C:
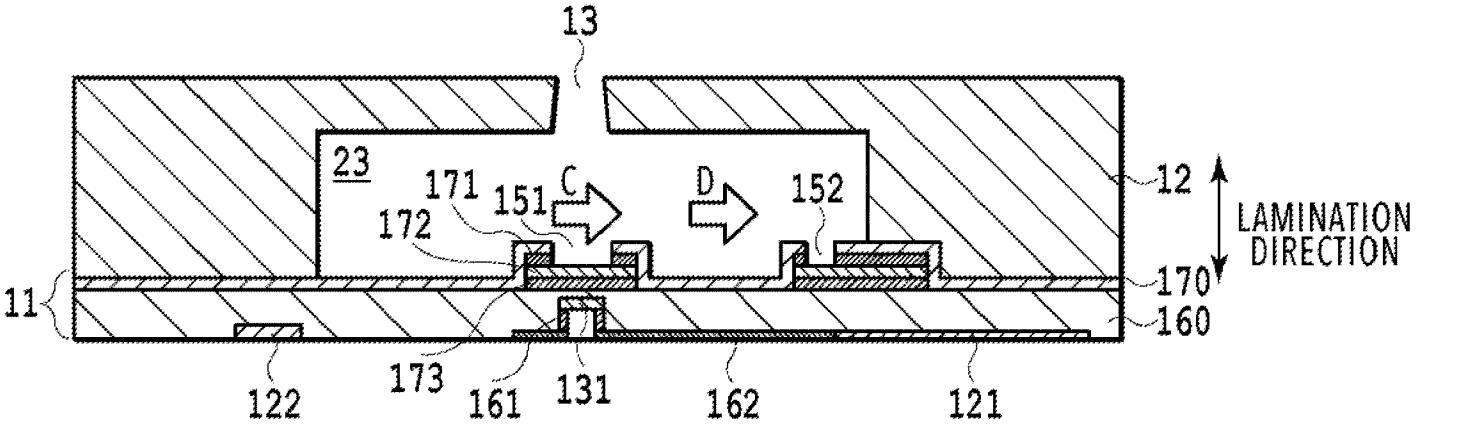
FIG. 11C is a diagram that illustrates a cross-sectional view of the periphery of the print elements in the second region.

FIGS. 11A to 11C are diagrams that illustrate planes and a section of the print element periphery 140*b* in the second region 111*b* of FIG. 10. FIG. 11A is a plan view that illustrates a configuration of the upper layer over the layer including the print elements 131 in the print element periphery 140*b* in the second region 111*b* of FIG. 10. FIG. 11B is a plan view that illustrates a configuration of the layer including the print elements 131 or the lower layer below the layer including the print elements 131 in the print element periphery 140*b* in the second region 111*b* of FIG. 10. FIG. 11C is a cross-sectional view of the XIC-XIC portion of FIG. 11A.

As illustrated in FIG. 11C, in the lower layer below the layer including the print elements 131, the drive circuits 121 and the temperature detection elements 122 are arranged to be away from the supply ports 17*a* and the collection ports 17*b*. The print elements 131 are electrically connected with the drive circuits 121 through the wiring layer 162.

As described above, the electric connections and interferences between the elements have to be considered for the configuration of the lower layer below the layer including the print elements 131, and in a case where designs of the first region 111*a* and the second region 111*b* are changed individually, the load is increased. For this reason, the constituents such as the drive circuits 121, the print elements 131, the external connection terminal aligned rows 16*a* and 16*b* connected with the drive circuits 121, and the temperature detection elements 122 are point-symmetrically arranged based on the consideration of increase of the efficiency of the layout design of the substrate.

The first electrode wiring patterns 141*a* and 141*b* and the second electrode wiring patterns 142*a* and 142*b* illustrated in FIG. 10 are arranged on the upper layer over the layer including the print elements 131 with the insulation layer 160 interposed therebetween. Thus, for the first and second electrode wiring patterns, there is no need of considering interferences in a substrate plane direction on the drive circuits 121 and the temperature detection elements 122 in the lower layer below the insulation layer 160 and the wiring layer 162 electrically connected with the drive circuits 121 and the temperature detection elements 122 in the lower layer below the insulation layer 160. For this reason, restriction of arrangement and design load due to the pattern changing are less than a case of the patterns in the layer including the print elements 131 and the lower layer below the layer including the print elements 131.

In this embodiment, the second electrode wiring patterns 142*a* and 142*b* are arranged close to the collection ports 17*b* in both the first region 111*a* and the second region 111*b*. Specifically, an installation position of the wiring pattern is changed such that the second electrode wiring pattern 142*b* extending in a form of comb-teeth in the second region 111*b* is arranged close to the collection ports 17*b*. The pattern extending in the form of comb-teeth is the following pattern. First, the wiring pattern is arranged to extend from the terminal of the external connection terminal aligned row 16*b* in the direction crossing the print element row direction. That is, the wiring pattern is installed from the external connection terminal to extend toward an end on the side having no external connection terminal aligned row. In the middle of the extending, the wiring pattern is branched in two and one is installed to extend in the print element row direction. The other of this branched wiring pattern is applied to all the print element rows except the print element row at the end on the side having no external connection terminal aligned row. For the remaining print element row at the end on the side having no external connection terminal aligned row, the wiring pattern is arranged while not being branched but curved.

In this embodiment, the first electrode wiring patterns 141*a* and 141*b* and the second electrode wiring patterns 142*a* and 142*b* are both arranged while extending in the form of comb-teeth. The positions of branches in the print element row direction are different between the first region 111*a* and the second region 111*b*. As a result, as illustrated in FIGS. 11A to 11C, the configurations of the layer including the print elements 131 and the lower layer below the layer including the print elements 131 in the second region are point-symmetric to the first region pattern, and the electrode wiring patterns of the upper layer over the layer including the print elements has the arrangement configuration that allows the ink circulation direction to be the same as that in the first region. That is, the first electrode wiring patterns 141*a* and 141*b* and the second electrode wiring patterns 142*a* and 142*b* are arranged in a direction of liquid flow in which the liquid flows from the supply ports 17*a* to the collection ports 17*b* while passing above the print elements 131. For this reason, the second electrodes 152 are formed in the periphery of the collection ports 17*b* in the second region 111*b* as well. As a result, the pigment particle repelling direction D is the same direction as the ink circulation direction C. Thus, in this embodiment, it is possible to make the ink circulation direction C and the repelling direction D of the pigment particles in the ink in the same direction in the second region 111*b* as well, and this makes it possible to prevent decrease of the kogation preventive effect.

As described above, in this embodiment, it is possible to reduce the design load while maintaining the kogation preventive effect by changing the installation position of the second electrode wiring pattern 142*b* arranged in the form of comb-teeth in the upper layer over the layer including the print elements 131. That is, in this embodiment, the point-symmetric arrangement about the center of the substrate is applied to layout designs of the layer including the print elements and the lower layer below the layer including the print elements, which may be the main cause of the size increase of the substrate and the design load. Specifically, the print elements and the drive circuits are arranged point-symmetrically about the center of the substrate. Besides, the second electrodes for the kogation prevention are arranged close to the collection ports in both the first and second regions. As a result, it is possible to prevent decrease of the effect of the functional elements while inhibiting the chip size increase and reducing the design load by increasing efficiency of the layout. That is, it is possible to prevent adhesion of kogation on the surfaces of the print elements without affecting the ink discharge features and to improve the printing quality.

Embodiment 2

In this embodiment, a mode in which pre-heating wiring pattern (pre-heating element) for pre-heating the ink is arranged as the functional element is described. Specifically, a configuration in which the pre-heating wiring pattern as the functional element is arranged close to the ink supply path in addition to the configuration of Embodiment 1 is described.

Figure 12:
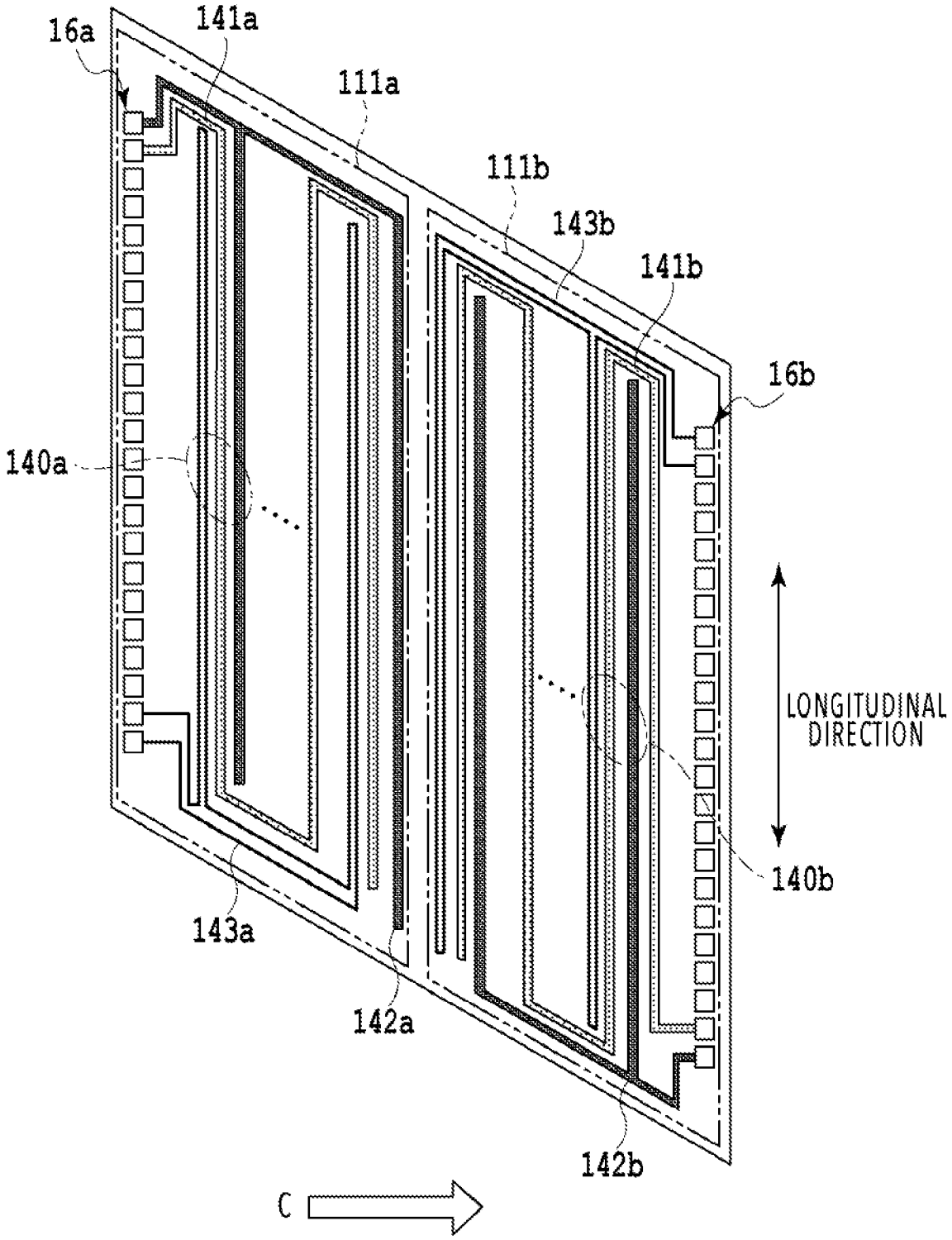
FIG. 12 is a diagram that illustrates plane patterns in the upper layer over the layer including the print elements.

FIG. 12 is a diagram that illustrates plane patterns of the first adhesive layer 171 and the second protection layer 172 in the upper layer over the layer including the print elements 131 of the substrate 11 in Embodiment 2. In this embodiment, the arrangement configurations of the layer including the print elements 131 and the lower layer below the layer including the print elements 131 are the same as that described in Embodiment 1. In FIG. 12, pre-heating wiring patterns 143*a* and 143*b* are arranged in addition to the first electrode wiring patterns 141*a* and 141*b* and the second electrode wiring patterns 142*a* and 142*b* described in FIG. 10.

In this embodiment, in order to prevent an effect on the ink discharge features due to decrease of the environment temperature, the pre-heating wiring patterns 143*a* and 143*b* for pre-heating are arranged close to the supply ports for pre-heating the ink immediately before supplying the ink to the print elements 131. The pre-heating herein means pre-heating the ink to a temperature that is not as high as the temperature at which the ink is discharged. The materials forming the wiring patterns for pre-heating are preferably the same materials as that of the first and second electrode patterns for reducing the load in the production step.

The object of the pre-heating wiring patterns 143*a* and 143*b* is to heat the ink. Thus, greater currents have to be applied to the pre-heating wiring patterns 143*a* and 143*b* than that applied to the first and second electrodes. In addition, since the pre-heating wiring patterns 143*a* and 143*b* have to be driven in a case where the environment temperature is decreased, the pre-heating wiring patterns 143*a* and 143*b* are configured to be electrically independent from the first and second electrodes 151 and 152 to which voltages are applied for the kogation prevention.

Figure 13:
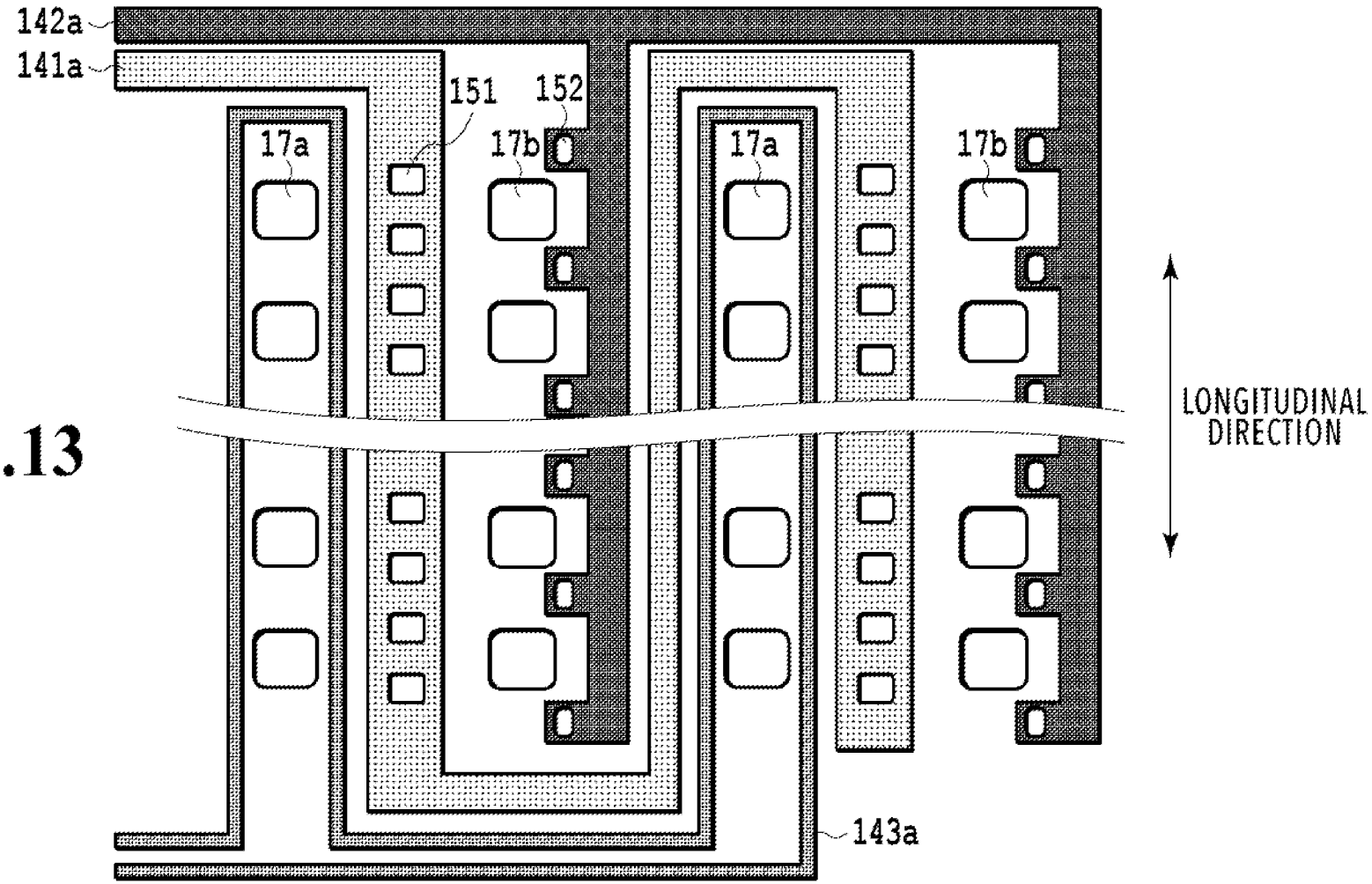
FIG. 13 is a plan view that schematically illustrates patterns in the upper layer over the layer including the print elements in the first region.
Figure 14:
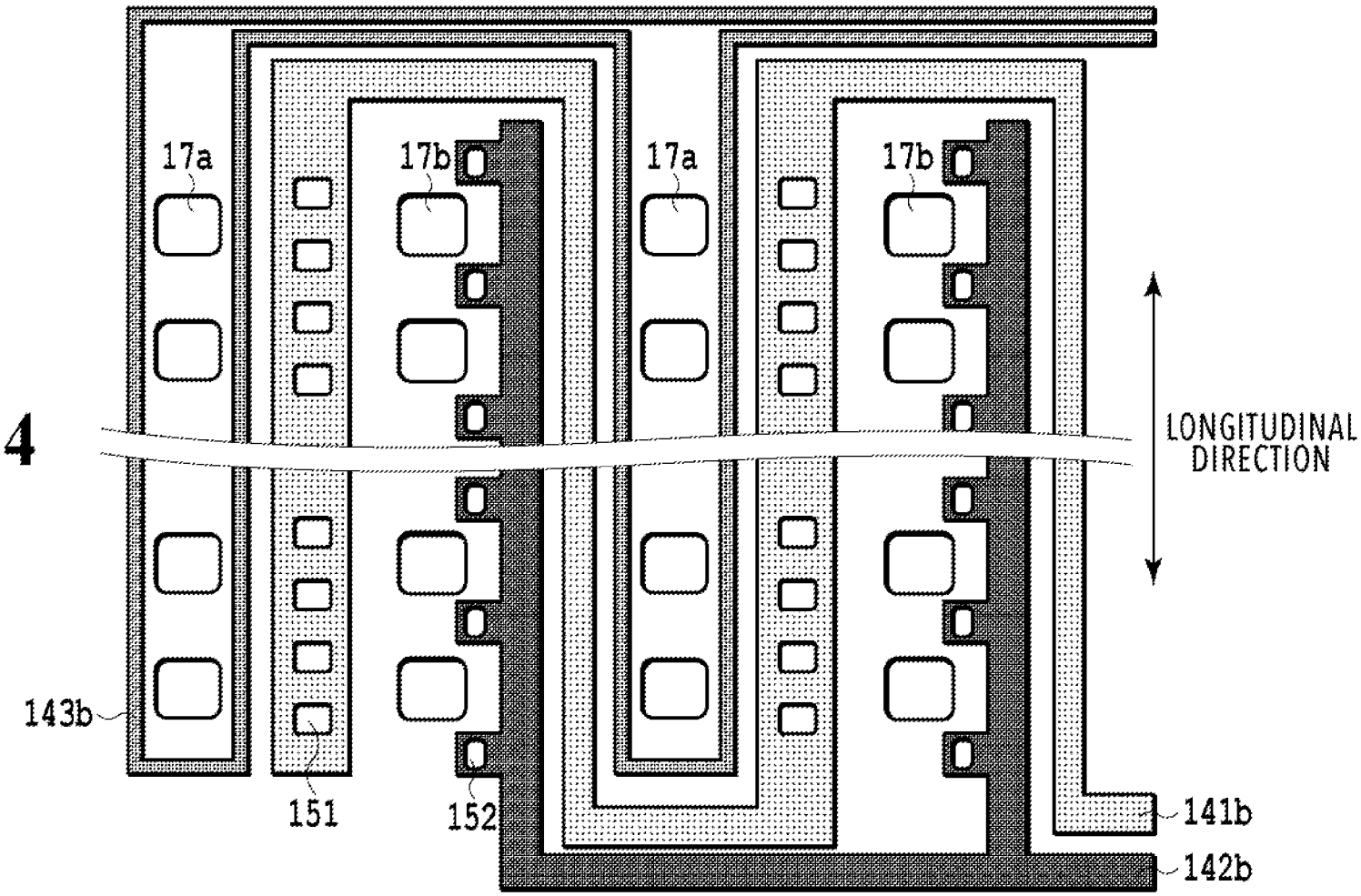
FIG. 14 is a plan view that schematically illustrates patterns in the upper layer over the layer including the print elements in the second region.

FIG. 13 is a plan view that schematically illustrates a pattern of the upper layer over the layer including the print elements 131 in the first region of Embodiment 2. FIG. 14 is a plan view that schematically illustrates a pattern of the upper layer over the layer including the print elements 131 in the second region of Embodiment 2.

As illustrated in FIGS. 13 and 14, in the case where the pre-heating wiring patterns 143*a* and 143*b* are arranged close to the supply ports 17*a*, the pre-heating wiring patterns 143*a* and 143*b* are formed to be electrically independent from the first electrode wiring patterns 141*a* and 141*b* and the second electrode wiring patterns 142*a* and 142*b*. Specifically, the pre-heating wiring patterns 143*a* and 143*b* are each arranged as a pattern in a form of folded comb-teeth. The pattern in the form of folded comb-teeth is similar to the abovementioned pattern of the form of comb-teeth but the comb-teeth portions thereof (i.e., portions that are installed while being branched) are folded. For example, the pattern forms the comb-teeth such that the wiring installed in the print element row direction from a vicinity of a first end in the print element row direction is folded in a vicinity of a second end in the opposite side and returns to the vicinity of the first end. Specifically, two wirings are installed from two terminals of each of the external connection terminal aligned rows 16*a* and 16*b*. One of the comb-teeth is formed such that one of the two installed wirings is arranged to extend from the vicinity of the first end to the vicinity of the second end in the print element row direction and folded in the vicinity of the second end. Since the pre-heating wiring patterns 143*a* and 143*b* heat the wiring patterns themselves by application of currents, the two ends have to be electrically connected with the two ends of each of the external connection terminal aligned rows 16*a* and 16*b*. For this reason, two wirings are installed from the external connection terminal aligned rows 16*a* and 16*b*.

In this embodiment, the first electrode wiring patterns 141*a* and 141*b* are arranged as a single meandering pattern. The single meandering pattern is a pattern that is different from the abovementioned comb-teeth form and is formed with no branches but curvings in some portions. That is, the pattern installed from the external connection terminal aligned rows 16*a* and 16*b* in the direction crossing the print element row direction is arranged to be curved at predetermined positions and extends from the vicinity of the first end to the vicinity of the second end in the print element row direction. Thereafter, in the vicinity of the second end, the pattern is further installed to a predetermined position in the opposite side of the external connection terminals in the direction crossing the print element row direction. Then, the pattern is arranged to be curved and extends from the vicinity of the second end to the vicinity of the first end in the print element row direction. The first electrode wiring patterns 141*a* and 141*b* are formed by meandering in this way. The second electrode wiring patterns 142*a* and 142*b* are arranged to extend in the form of comb-teeth like Embodiment 1.

The reason of employing the abovementioned arrangement patterns is described. As described in the comparative example and Embodiment 1, if the configuration in which the constituents including the external connection terminal aligned rows 16*a* and 16*b* are point-symmetric is employed, the first electrode wiring patterns, the second electrode wiring patterns, and the external connection terminal aligned rows 16*a* and 16*b* connected to the pre-heating wiring patterns are point-symmetric as well. In addition, as described above, the two ends of the pre-heating wiring patterns 143*a* and 143*b* have to be electrically connected with the two terminals of each of the external connection terminal aligned rows 16*a* and 16*b*. In this case, if the second electrodes 152 are arranged close to the collection ports 17*b* like Embodiment 1 and two or more print element row groups are made in each region, the pre-heating wiring patterns 143*a* and 143*b* interfere with either the first or second electrode wiring patterns.

For this reason, the first electrode wiring patterns 141*a* and 141*b* in this embodiment have the meandering form. This makes it possible to arrange the external connection terminal aligned rows 16*a* and 16*b* point-symmetrically even in a case where multiple print element row groups are provided in each region. It is also possible to arrange the pre-heating wiring patterns close to the supply ports 17*a* while arranging the second electrodes 152 close to the collection ports 17*b*. The example in which the first electrode wiring patterns 141*a* and 141*b* have the meandering form is described; however, the second electrode wiring patterns 142*a* and 142*b* may have the meandering form.

Figure 15A:
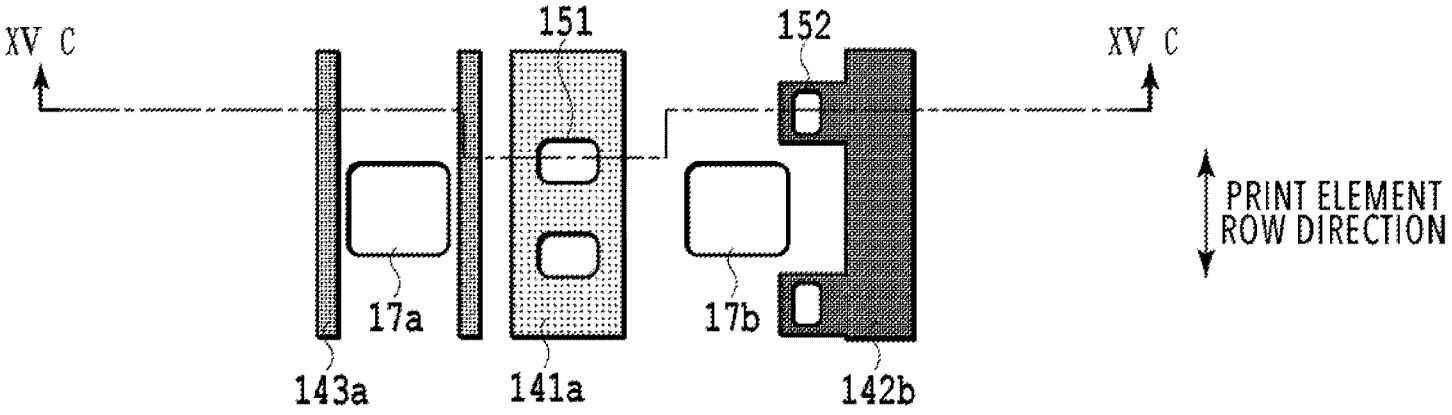
FIG. 15A is a diagram that illustrates a plan view of the periphery of the print elements in the first region.
Figure 15B:
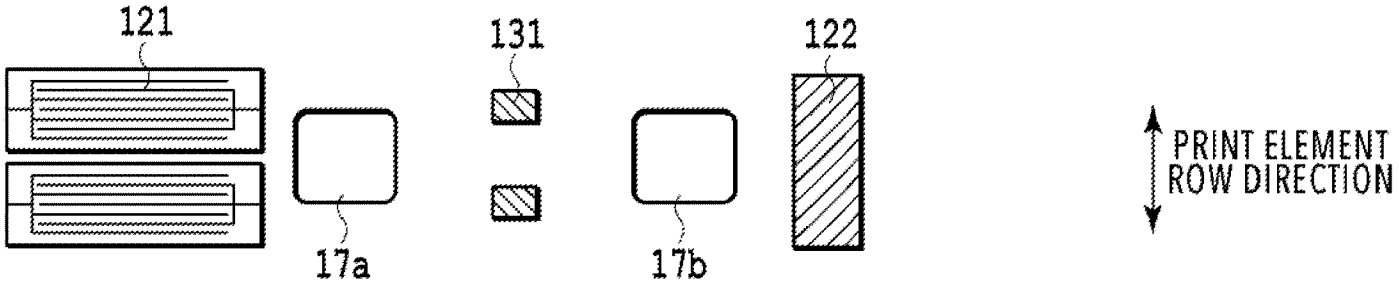
FIG. 15B is a diagram that illustrates a plan view of the periphery of the print elements in the first region.
Figure 15C:
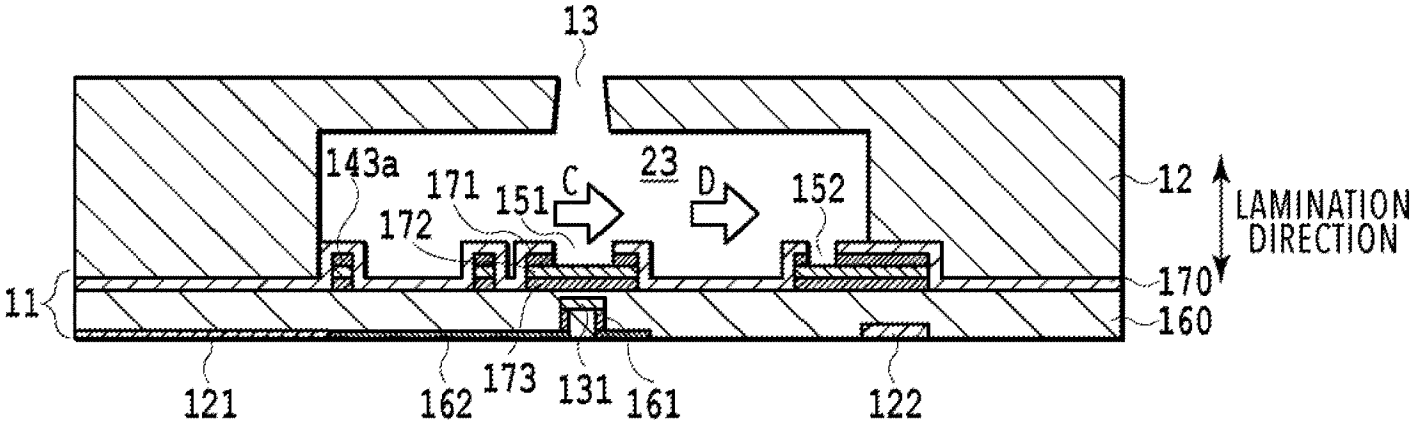
FIG. 15C is a diagram that illustrates a cross-sectional view of the periphery of the print elements in the first region.

FIGS. 15A to 15C are diagrams that illustrate planes and a section of the print element periphery 140*a* in the first region 111*a* of FIG. 12. FIG. 15A is a plan view that illustrates a configuration of the upper layer over the layer including the print elements 131 in the print element periphery 140*a* in the first region 111*a* of FIG. 12. FIG. 15B is a plan view that illustrates a configuration of the layer including the print elements 131 or the lower layer below the layer including the print elements 131 in the print element periphery 140*a* in the first region 111*a* of FIG. 12. FIG. 15C is a cross-sectional view of the XVC-XVC portion of FIG. 15A.

Figure 16A:
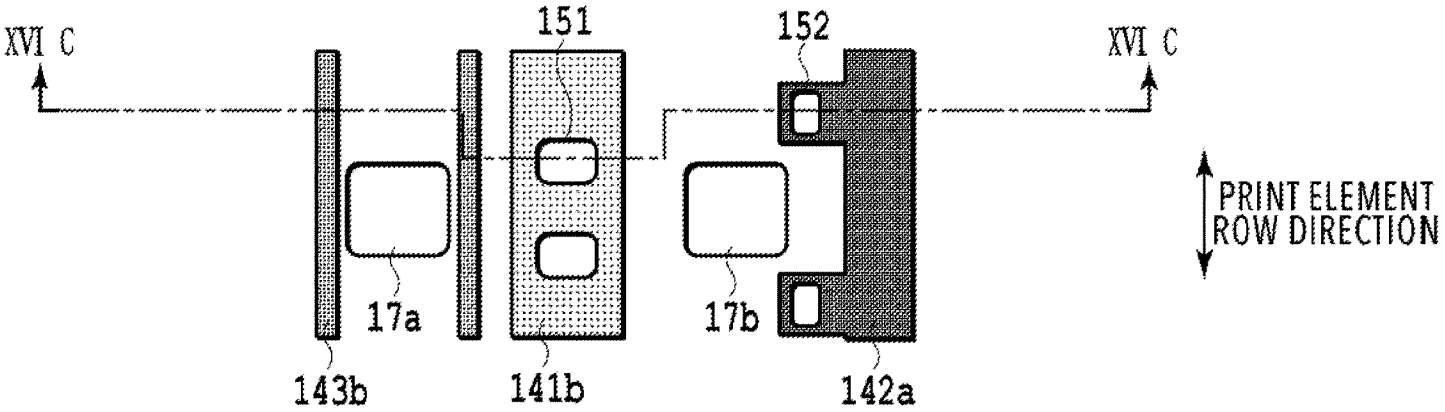
FIG. 16A is a diagram that illustrates a plan view of the periphery of the print elements in the second region.
Figure 16B:
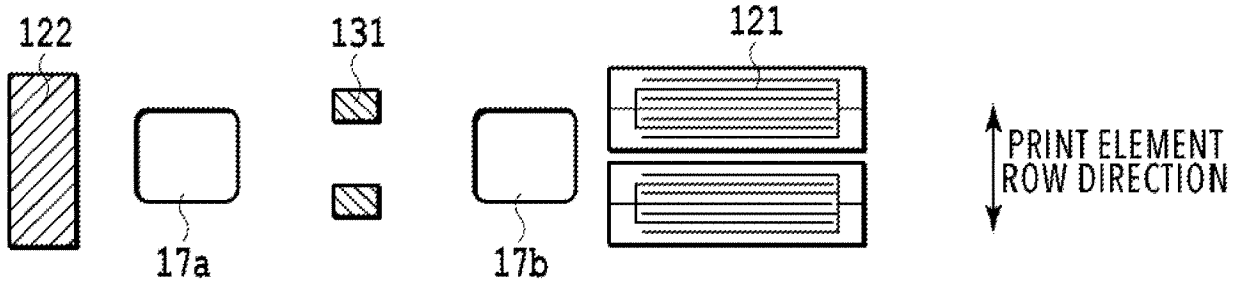
FIG. 16B is a diagram that illustrates a plan view of the periphery of the print elements in the second region.
Figure 16C:
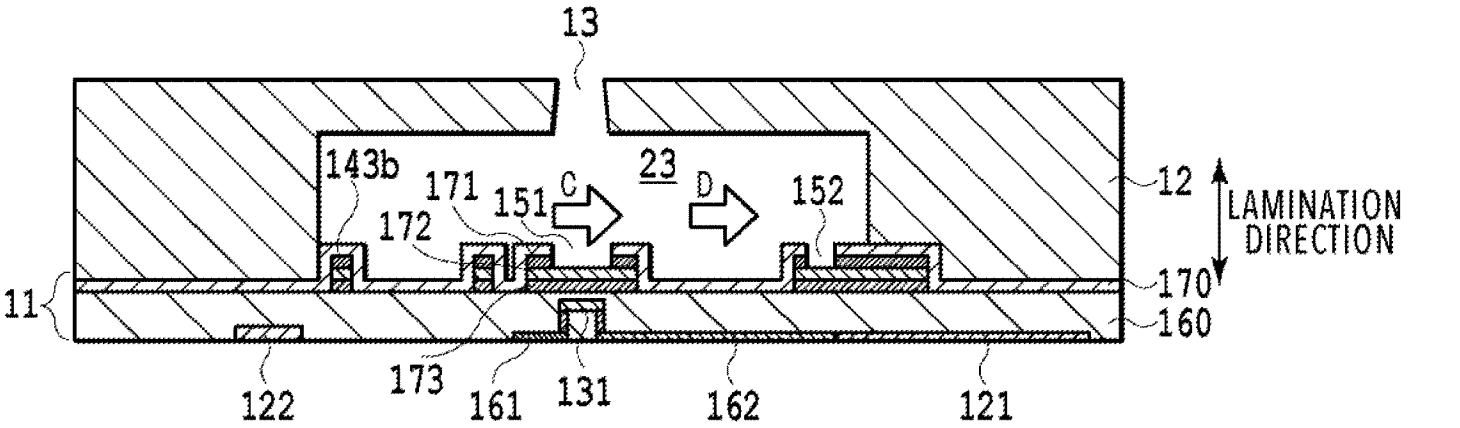
FIG. 16C is a diagram that illustrates a cross-sectional view of the periphery of the print elements in the second region.

FIGS. 16A to 16C are diagrams that illustrates planes and a section of the print element periphery 140*b* in the second region 111*b* of FIG. 12. FIG. 16A is a plan view that illustrates a configuration of the upper layer over the layer including the print elements 131 in the print element periphery 140*b* in the second region 111*b* of FIG. 12. FIG. 16B is a plan view that illustrates a configuration of the layer including the print elements 131 or the lower layer below the layer including the print elements 131 in the print element periphery 140*b* in the second region 111*b* of FIG. 12. FIG. 16C is a cross-sectional view of the XVIC-XVIC portion of FIG. 16A.

As illustrated in FIGS. 15A and 16A, both the pre-heating wiring patterns 143*a* and 143*b* are arranged in the periphery of the supply ports 17*a*. As described in Embodiment 1, the electric field is formed between the first electrodes 151 and the second electrodes 152 through the ink for the kogation prevention. In order to prevent the pre-heating wiring patterns 143*a* and 143*b* to which currents are applied from affecting the formation of the electric field, the pre-heating wiring patterns 143*a* and 143*b* are configured to be insulated from the ink. Specifically, the pre-heating wiring patterns 143*a* and 143*b* are covered by the second adhesive layer 170. This makes it possible to reduce the load of the substrate design without affecting the electric field for the kogation prevention while arranging the pre-heating wiring patterns 143*a* and 143*b* closer to the ink than the case of forming the pre-heating wiring patterns in the lower layer below the insulation layer 160.

In this embodiment, the mode in which the pre-heating wiring patterns 143*a* and 143*b* are arranged to be wired around the outer periphery of the supply ports 17*a*; however, another arrangement may be applied as long as the pre-heating wiring patterns 143*a* and 143*b* are arranged within the pressure chamber 23. For example, the pre-heating wiring patterns may be arranged between the print elements 131 and the supply ports 17*a*. Otherwise, the pre-heating wiring patterns may be arranged to be folded to the outer sides of the supply ports 17*a*.

Embodiment 3

In Embodiment 2, the mode in which the first and second electrodes for the kogation prevention and the pre-heating wiring patterns for the pre-heating of the ink are arranged as the functional elements is described. In this embodiment, a mode in which the first and second electrodes for the kogation prevention are not arranged and only the pre-heating wiring patterns are arranged as the functional elements is described. That is, at least one kind of functional element may be arranged in each print element row. Either kind of the first electrodes and the second electrodes for the kogation prevention may be arranged as described in Embodiment 1, or one kind of the pre-heating wiring patterns for the pre-heating of the ink may be arranged as described in this embodiment.

Figure 17:
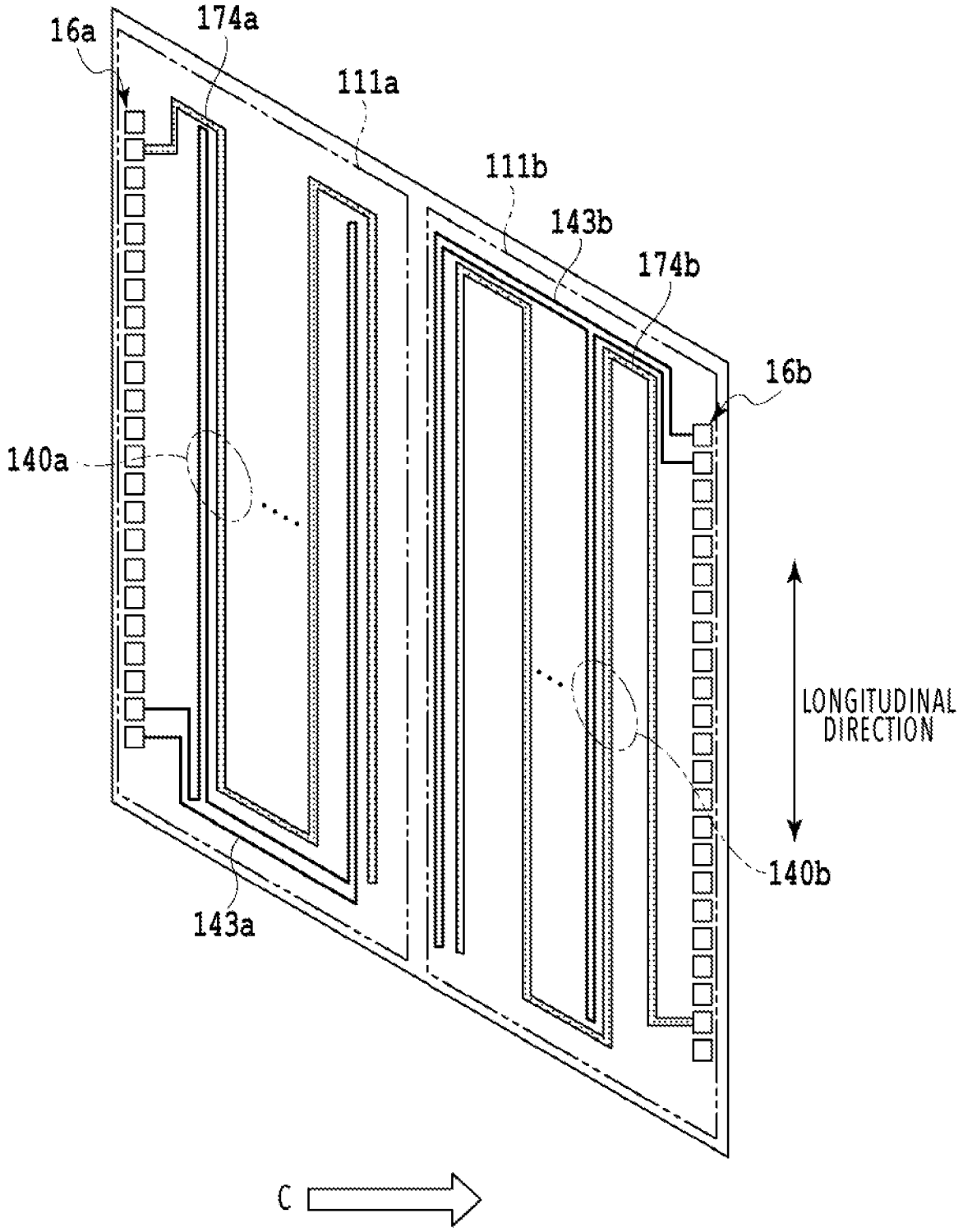
FIG. 17 is a plan view that schematically illustrates patterns in the upper layer over the layer including the print elements in the second region.

FIG. 17 is a diagram that illustrates a plane pattern of the first adhesive layer 171 of the upper layer over the layer including the print elements 131 of the substrate 11 in Embodiment 3. In this embodiment, the arrangement configurations of the layer including the print elements 131 and the lower layer below the layer including the print elements 131 are the same as that described in Embodiment 2. In FIG. 17, the first electrode wiring patterns 141*a* and 141*b* and the second electrode wiring patterns 142*a* and 142*b* described in FIG. 12 are not arranged. The pre-heating wiring patterns 143*a* and 143*b* are arranged like FIG. 12. Protection layer patterns 174*a* and 174*b* are arranged in the same patterns as the first electrode wiring patterns in FIG. 12.

Figure 18A:
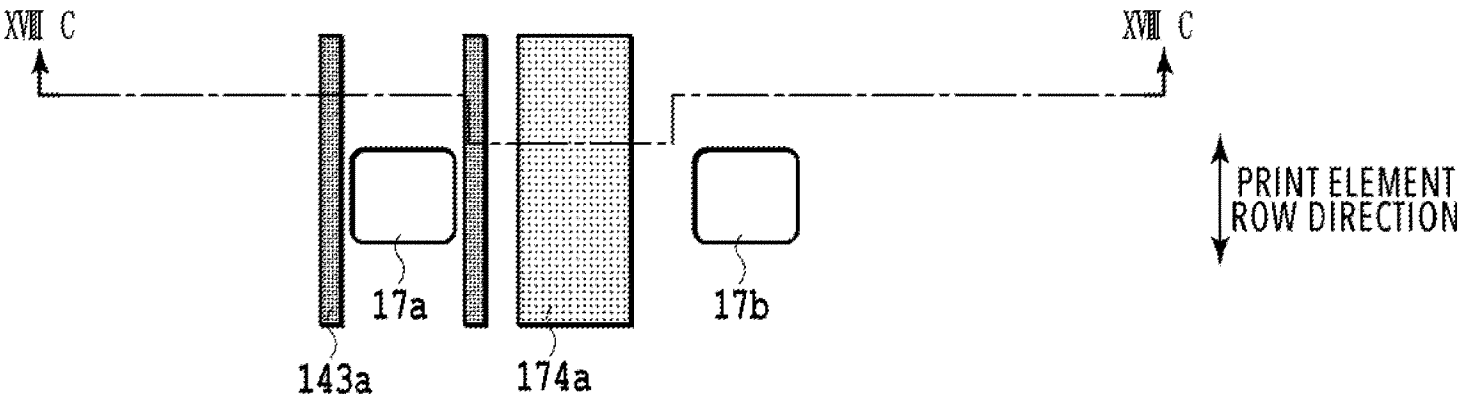
FIG. 18A is a diagram that illustrates a plan view of the periphery of the print elements in the first region.
Figure 18B:
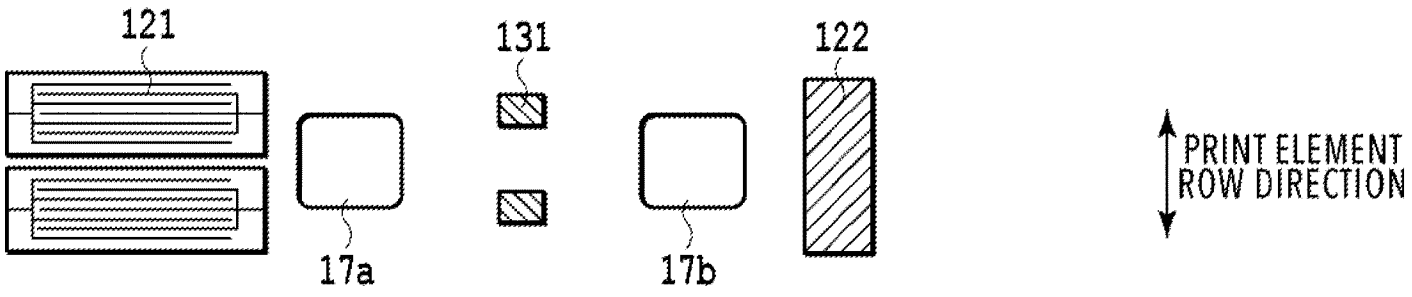
FIG. 18B is a diagram that illustrates a plan view of the periphery of the print elements in the first region.
Figure 18C:
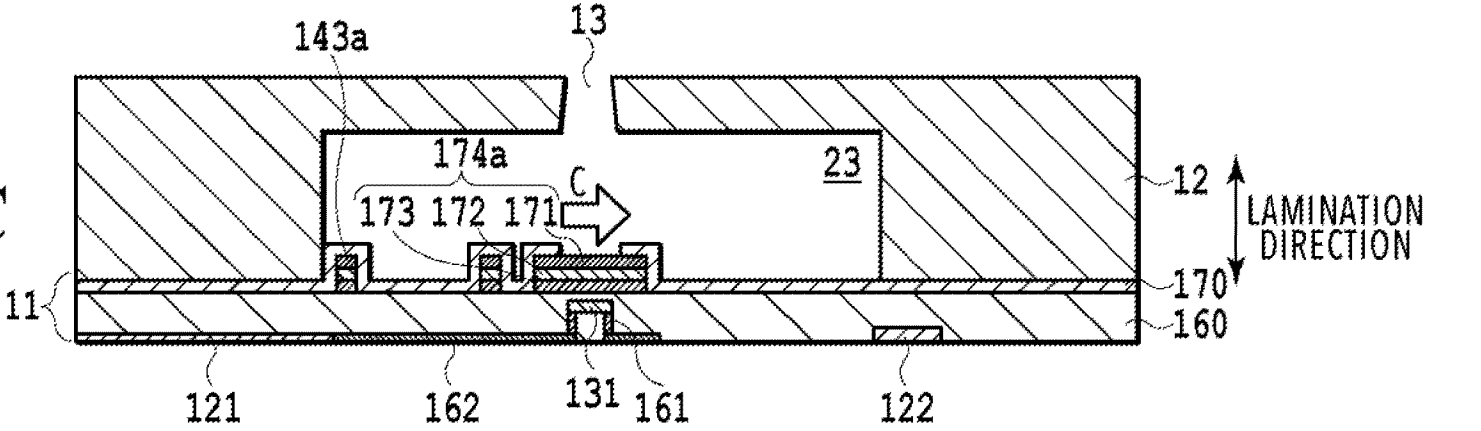
FIG. 18C is a diagram that illustrates a cross-sectional view of the periphery of the print elements in the first region.

FIGS. 18A to 18C are diagrams that illustrate planes and a section of the print element periphery 140*a* in the first region 111*a* of FIG. 17. FIG. 18A is a plan view that illustrates a configuration of the upper layer over the layer including the print elements 131 in the print element periphery 140*a* in the first region 111*a* of FIG. 17. FIG. 18B is a plan view that illustrates a configuration of the layer including the print elements 131 or the lower layer below the layer including the print elements 131 in the print element periphery 140*a* in the first region 111*a* of FIG. 17. FIG. 18C is a cross-sectional view of the XVIIIC-XVIIIC portion of FIG. 18A.

Figure 19A:
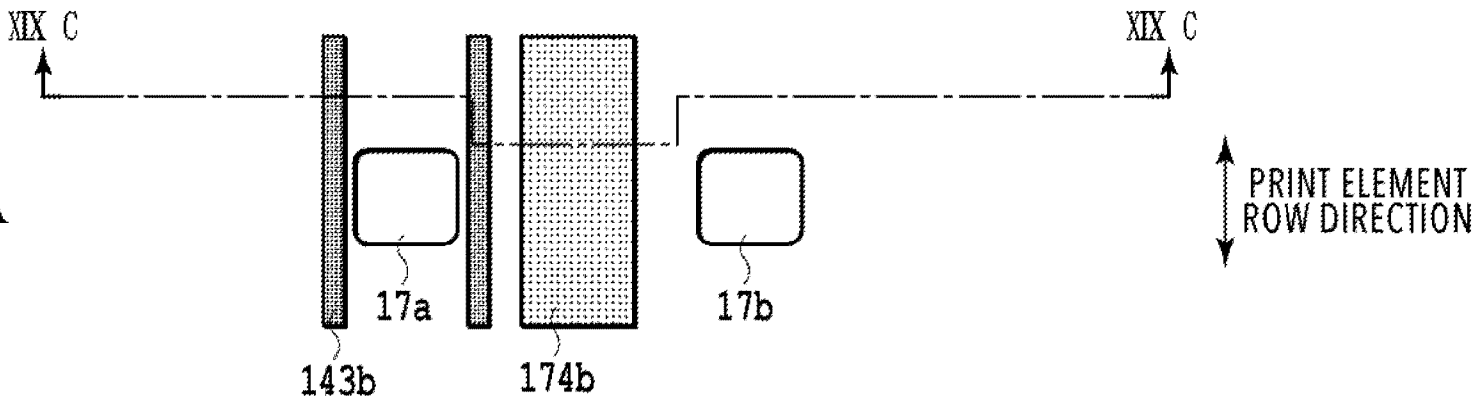
FIG. 19A is a diagram that illustrates a plan view of the periphery of the print elements in the second region.
Figure 19B:
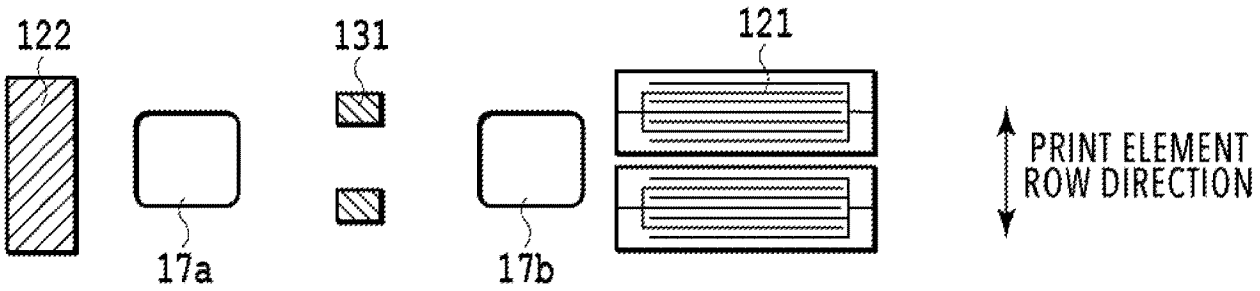
FIG. 19B is a diagram that illustrates a plan view of the periphery of the print elements in the second region.
Figure 19C:
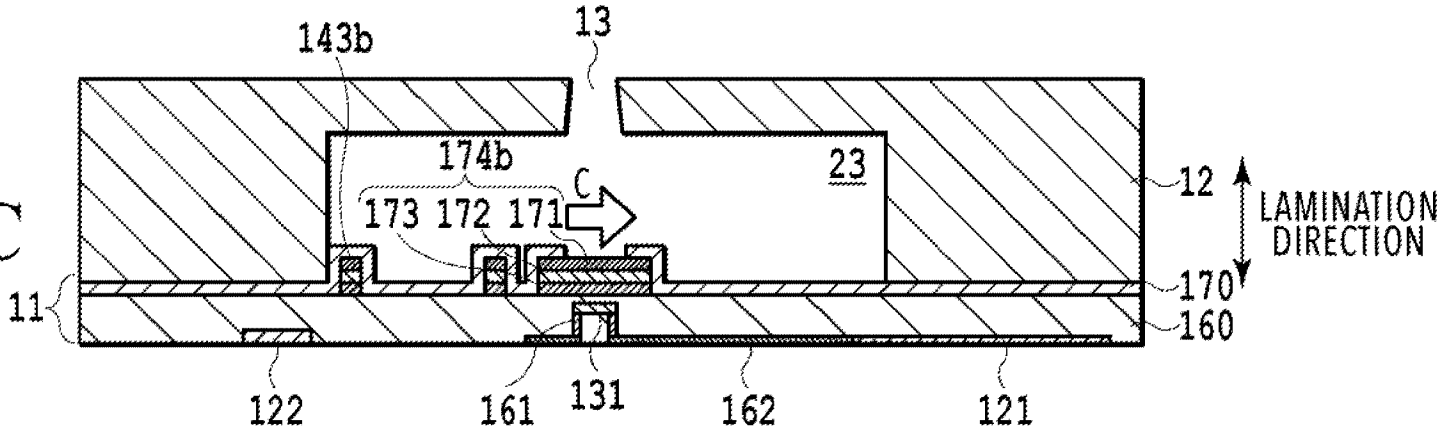
FIG. 19C is a diagram that illustrates a cross-sectional view of the periphery of the print elements in the second region.

FIGS. 19A to 19C are diagrams that illustrates planes and a section of the print element periphery 140*b* in the second region 111*b* of FIG. 17. FIG. 19A is a plan view that illustrates a configuration of the upper layer over the layer including the print elements 131 in the print element periphery 140*b* in the second region 111*b* of FIG. 17. FIG. 19B is a plan view that illustrates a configuration of the layer including the print elements 131 or the lower layer below the layer including the print elements 131 in the print element periphery 140*b* in the second region 111*b* of FIG. 17. FIG. 19C is a cross-sectional view of the XIXC-XIXC portion of FIG. 19A.

The protection layer patterns 174*a* and 174*b* are patterns each formed of the first adhesive layer 171, the second protection layer 172, and the first protection layer 173 are laminated in this order from the top (discharge port side) of the substrate 11 in the lamination direction. The protection layer patterns 174*a* and 174*b* have a function of protecting the surfaces of the print elements 131 from chemical and physical impacts caused by the heating of the print elements 131.

As described above, it is possible to reduce the decrease of the effects of the functional elements by arranging only the pre-heating wiring patterns 143*a* and 143*b* as the functional elements. That is, it is possible to obtain an effect of improving the discharge features during the bubbling while inhibiting the chip size increase and reducing the design load by increasing efficiency of the layout.

Another Embodiment

In Embodiment 2, the example in which the first electrode wiring patterns are arranged as a single meandering pattern, the second electrode wiring patterns are arranged in the form of comb-teeth, and the pre-heating wiring patterns are arranged in the form of folded comb-teeth is described. In the configuration of Embodiment 2, a plane layout from which the pre-heating wiring patterns are removed may be employed. That is, as described in Embodiment 1, even in a case where only the kogation prevention is performed, one of the first and second electrode patterns may be in the single meandering form and the other may be arranged in the form of comb-teeth. Even with this mode, it is possible to obtain the effect of the kogation prevention similarly as Embodiment 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-119919, filed Jun. 25, 2018, which is hereby incorporated by reference wherein in its entirety.

What is claimed is:

1. A print element substrate comprising:

a print element row group including at least one or more print element rows each including a plurality of print elements that are aligned in a first direction and allow a liquid to be discharged, supply ports that allow the liquid to flow into the print element substrate from outside, collection ports that allow the liquid to flow out to the outside, and drive circuits that drive the print elements, the print element rows being arranged in a second direction crossing the first direction; and two ends in the second direction each provided with external connection terminals that are electrically connected with the print elements, wherein a first region and a second region of the print element substrate each include the print element row group and the external connection terminals, the print element row group in the first region includes the print element row in which the drive circuit, the supply port, the print element, and the collection port are arranged in this order in the second direction from the first region to the second region, and the print element row group in the second region includes the print element row in which the supply port, the print element, the collection port, and the drive circuit are arranged in this order in the second direction from the first region to the second region.

2. The print element substrate according to claim 1, wherein each of the print element rows includes a protection layer pattern including first electrodes formed for the respective print elements and a protection layer pattern including second electrodes formed for the respective collection ports, and the first electrodes are arranged immediately above the print elements, and the second electrodes are arranged in a periphery of the collection ports.

3. The print element substrate according to claim 2, wherein in both the first region and the second region, the protection layer pattern including the first electrodes and the protection layer pattern including the second electrodes are electrically connected to the external connection terminals respectively, and at least one of the protection layer pattern including the first electrodes and the protection layer pattern including the second electrodes is arranged in a form of comb-teeth.

4. The print element substrate according to claim 2, wherein in both the first region and the second region, the protection layer pattern including the first electrodes and the protection layer pattern including the second electrodes are electrically connected to the external connection terminals respectively, and at least one of the protection layer pattern including the first electrodes and the protection layer pattern including the second electrodes is arranged in a meandering form.

5. The print element substrate according to claim 2, wherein voltages are applied between the first electrodes and the second electrodes to allow a charged particle included in the liquid to be electrically repelled from the first electrodes during a liquid discharging operation.

6. The print element substrate according to claim 2, wherein the protection layer pattern including the first electrodes and the protection layer pattern including the second electrodes are formed in a wiring pattern of a conductive substance.

7. The print element substrate according to claim 6, wherein the conductive substance forming the wiring pattern is made of at least one of tantalum, iridium, and an alloy including tantalum, iridium, and aluminum.

8. The print element substrate according to claim 1, wherein each of the print element rows includes pre-heating wirings that pre-heat the liquid during a liquid discharging operation, the pre-heating wirings being arranged close to supply ports.

9. The print element substrate according to claim 8, wherein in both the first region and the second region, the pre-heating wirings are electrically connected with the external connection terminals respectively and are arranged in a form of folded comb-teeth.

10. The print element substrate according to claim 1, wherein at least one or more temperature detection elements that detect temperature of the print element substrate are arranged in each print element row, and the temperature detection element in the first region is arranged closer to the external connection terminal than the supply port in the second direction, and the temperature detection element in the second region is arranged closer to the external connection terminal than the collection port in the second direction.

11. A liquid discharge head comprising:

the print element substrate according to claim 1, wherein the print element substrate includes pressure chambers provided with the print elements therein, and the liquid in the pressure chambers is circulated between inside and outside of the pressure chambers.

12. A liquid discharge apparatus comprising:

a liquid discharge head that includes a plurality of the print element substrates according to claim 1 in the first direction, a common supply flow path, and a common collection flow path; and a tank that stores the liquid, wherein the liquid is circulated from the tank, through the common supply flow path, the print element substrates, and the common collection flow path, to the tank.

* * * * *